United States Patent [19]

Izumi et al.

[11] Patent Number: 4,967,557

[45] Date of Patent: Nov. 6, 1990

[54] CONTROL SYSTEM FOR LOAD-SENSING HYDRAULIC DRIVE CIRCUIT

[75] Inventors: Eiki Izumi, Ibaragi; Yasuo Tanaka, Tsukuba; Hiroshi Watanabe, Ushiku; Kuniaki Yoshida, Tsuchiura; Toichi Hirata, Ushiku, all of Japan

[73] Assignee: Hitachi Construction Machinery Co., Ltd., Tokyo, Japan

[21] Appl. No.: 301,718

[22] Filed: Jan. 26, 1989

[30] Foreign Application Priority Data

Jan. 27, 1988 [JP] Japan ..... 63-16554

[51] Int. Cl.[5] ..... F15B 11/16; E02F 9/20; E02F 9/22; F02D 29/04

[52] U.S. Cl. ..... 60/423; 60/426; 60/431; 60/433; 60/449; 60/452; 91/446; 91/518; 91/529

[58] Field of Search ..... 60/423, 426, 431, 433–434, 60/449, 452; 91/446, 518, 529, 531

[56] References Cited

U.S. PATENT DOCUMENTS

| | | | |
|---|---|---|---|
| 4,395,199 | 7/1983 | Izumi et al. | 60/449 X |
| 4,617,854 | 10/1986 | Kropp | 91/531 X |
| 4,747,335 | 5/1988 | Budzich | 91/448 X |
| 4,809,504 | 3/1989 | Izumi et al. | 60/449 X |

FOREIGN PATENT DOCUMENTS

| | | |
|---|---|---|
| 0062072 | 10/1982 | European Pat. Off. . |
| 0150308 | 8/1985 | European Pat. Off. . |
| 3422165 | 12/1984 | Fed. Rep. of Germany . |
| 134342 | 8/1983 | Japan . |
| 174707 | 10/1983 | Japan . |
| 11706 | 1/1985 | Japan . |
| 195339 | 10/1985 | Japan . |
| 222601 | 11/1985 | Japan . |
| 4848 | 1/1986 | Japan . |
| 11429 | 1/1986 | Japan . |
| 2171757 | 9/1986 | United Kingdom . |

*Primary Examiner*—Edward K. Look
*Assistant Examiner*—George Kapsalas
*Attorney, Agent, or Firm*—Fay, Sharpe, Beall, Fagan, Minnich & McKee

[57] ABSTRACT

Control system for a load-sensing hydraulic drive circuit comprising; at least one hydraulic pump; hydraulic actuators driven by the hydraulic pump; and a pressure compensated flow control valve between the pump and each of the actuators, for controlling a flow rate of fluid to each actuator in response to a control signal. The control system has first detection means for detecting a differential pressure between the pump delivery pressure and the maximum load pressure; second detection means for detecting the pump delivery pressure; first means for calculating a differential pressure target pump delivery amount QΔp to hold the differential pressure constant; second means for calculating an input limiting target pump delivery amount QT based on at least a pressure signal from the second detection means and an input limiting pump function; third means for selecting one of the differential pressure target delivery amount QΔp and the input limiting target delivery amount QT as a pump delivery amount target value Qo, and then controlling the pump delivery amount to not exceed the input amount QT; and fourth means for calculating a compensation value Qns to limit a total consumable actuator flow rate based on at least the input amount QT and the differential pressure target delivery amount QΔp when the input amount QT is selected by the third means, and then controlling the pressure compensated flow control valve based on the compensation valve Qns.

12 Claims, 17 Drawing Sheets

CONTROL SYSTEM FOR LOAD-SENSING HYDRAULIC DRIVE CIRCUIT

BACKGROUND OF THE INVENTION

The present invention relates to a load-sensing hydraulic drive circuit for hydraulic machines, such as hydraulic excavators and cranes, each equipped with a plurality of hydraulic actuators, and more particularly to a control system for a load-sensing hydraulic drive circuit, which is designed to control the flow rates of hydraulic fluid supplied to the hydraulic actuators using pressure compensated flow control valves, while holding the delivery pressure of a hydraulic pump higher by a predetermined value than the maximum load pressure among the hydraulic actuators.

In these days, a load-sensing hydraulic drive circuit has been employed in hydraulic machines, such as hydraulic excavators and cranes, each equipped with a plurality of hydraulic actuators.

The hydraulic drive circuit comprises a pressure compensated flow control valve connected between a hydraulic pump and each of the hydraulic actuators for controlling the flow rate of hydraulic fluid supplied to the hydraulic actuator in response to an operation signal from a control lever, and a load-sensing regulator for holding the delivery pressure of the hydraulic pump higher by a predetermined value than the maximum load pressure among the plural hydraulic actuators. The pressure compensated flow control valve has a pressure compensating function to maintain the flow rate constant regardless of fluctuations in the load pressure or the delivery pressure of the hydraulic pump, so that a flow rate proportional to the operated amount of each control lever is supplied to the associated hydraulic actuator. As a result, independent operations of the respective hydraulic actuators are ensured when a plurality of hydraulic actuators are operated in a combined manner. The load-sensing regulator functions to constantly maintain the delivery pressure of the hydraulic pump at a lower limit corresponding to the maximum load pressure among the hydraulic actuators for energy saving.

However, the above load-sensing hydraulic drive circuit has the following problem which is specific to load-sensing control. The delivery amount of a variable displacement hydraulic pump is determined by the product of its displacement, i.e., inclination angle of a swash plate, in the case of a swash plate type and the rotational speed of the pump. The larger the inclination angle of the swash plate, the larger the delivery amount of the pump. The inclination angle of the swash plate has an upper limit determined by the pump structure, at which upper limit of the delivery amount of the pump also reaches its maximum. But, the pump is driven by a prime mover, and if input torque of the pump exceeds output torque of the prime mover, the rotational speed of the prime mover would be reduced and even lost in the worst case. To avoid such an event, an input torque regulator has usually been equipped on the pump to limit the maximum inclination angle of the swash plate so that input torque of the pump will not exceed output torque of the prime mover, thereby controlling the delivery amount of the pump input torque limiting control.

When the total of demand flow rates for the plural actuators commanded by the respective control levers exceeds the available maximum delivery amount of the pump during combined operation of the actuators, the pump cannot increase the delivery amount (inclination angle) much more even though it is under the load-sensing control. In other words, the delivery amount of the pump is saturated. As a result, the delivery pressure of the pump is reduced and can no longer be maintained higher by a predetermined value than the maximum load pressure. Thus, the delivery amount of the pump is caused to largely flow into the actuator(s) on the lower pressure side, while the hydraulic fluid is not supplied to the actuator(s) on the higher pressure side, resulting in a problem that the combined operation of plural actuators cannot be performed smoothly.

To solve the above-mentioned problem, DE-A1-3422165 (corresponding to Japanese Patent Laid-Open No. 60-11706) has proposed such a circuit arrangement that a pair of opposing pilot chambers is added to a pressure balance valve of each pressure compensated flow control valve, and the delivery pressure of the pump is introduced to one of the pilot chambers which acts in the valve-opening direction, while the maximum load pressure among the plural actuators is introduced to the other pilot chamber which acts in the valve-closing direction. With the circuit arrangement, when the total of demanded flow rates for the plural actuators commanded by the respective control levers exceeds the maximum delivery amount of the pump, throttle openings of the respective pressure balance valves are reduced at the same proportion as each other in accordance with a reduction in the delivery pressure of the pump, so that the flow rates through the respective flow control valves are restricted in a manner corresponding to the ratios of throttle openings (demand flow rates) of the flow control valves. Therefore, the hydraulic fluid is reliably supplied to the actuator(s) on the higher pressure side as well, for achieving the combined operation with certainty.

The pressure compensated flow control valve determines a consumable flow rate, that is to be passed to the associated hydraulic actuator therethrough, based on both a throttle opening command value for the flow control valve given by an operation signal from the control lever and a differential pressure command value across the flow control valve given to the pressure balance valve. Both the throttle openings of the flow control valve and the pressure balance valve are controlled so that the actual flow rate through the pressure compensated flow control valve, i.e., the flow rate consumed by the actuator becomes equal to the consumable flow rate. In the above prior art, the differential pressure command value across the flow control valve is directly applied to the pressure balance valve hydraulically such that the delivery pressure of the pump and the maximum load pressure among the hydraulic actuators are introduced to the pressure balance valve in opposite directions, causing the differential pressure therebetween to act on the pressure balance valve. By so doing, the differential pressure command values applied to all the pressure balance valves are limited to compensate (reduce) the total consumable flow rate for all the hydraulic actuators. This reduces the total flow rate actually consumed by the actuators. Hereinafter, this type of control will be referred to as total consumable flow compensating control. It is to be noted that, in the total consumable flow compensating control in the above prior art, the differential pressure between the pump delivery pressure and the maximum load pressure is reduced responsive to deficiencies in the actual delivery pressure of the pump as compared with the demand flow rates commanded by the control levers, and hence, the total consumable flow rate is always coincident with the total of actual flow rates consumed by the hydraulic actuators.

In the foregoing prior art, because the pressure compensated flow control valve is controlled to be directly responsive to the differential pressure between the pump delivery pressure and the maximum load pressure for carrying out the total consumable flow compensating control, the load-sensing control of the pump and the total consumable flow compensating control of the pressure compensated flow control valve are concurrently controlled when the delivery pressure of the pump is reduced. This has accompanied the problem below.

More specifically, the load-sensing control controls the delivery amount of the pump to hold the differential pressure constant, and has a slower response speed than that of the total consumable flow compensating control, as the control of the delivery amount of the pump is carried out through various mechanisms. Therefore, when the delivery pressure of the pump is reduced at the moment the control lever is operated to start supply of the hydraulic fluid to the actuator or increase the supply amount thereof, the flow rate through the pressure compensated flow control valve starts to be restricted under the total consumable flow compensating control before the load-sensing control starts to increase the delivery amount of the pump. This causes the problem that in a transitional period, the flow rate supplied to the actuator cannot be increased and the operability is impaired even though the control lever is operated with an intention to increase the flow rate.

In a similar case, it may happen repeatedly that the pump delivery amount is increased under the load-sensing control to raise up the pump delivery pressure after the flow rate through the flow control valve has been restricted under the total consumable flow compensating control, then the total consumable flow compensating control is released to increase the flow rate through the flow control valve, causing the delivery pressure of the pump to be reduced, and thereafter the flow rate through the flow control valve is restricted under the total consumable flow compensating control before the load-sensing control has started to increase the pump delivery amount. In other words, the load-sensing control and the total consumable flow compensating control interfere with each other, thereby resulting in a hunting phenomenon.

It is an object of the present invention to provide a control system for a load-sensing hydraulic drive circuit which can perform the total consumable flow compensating control of pressure compensated flow control valves, even in the case when the delivery amount of the pump is saturated, ensuring excellent operability, and offering stable control, free of a hunting phenomenon.

SUMMARY OF THE INVENTION

To achieve the above object, according to the present invention, there is provided a control system for a load-sensing hydraulic drive circuit comprising; at least one hydraulic pump; a plurality of hydraulic actuators driven with hydraulic fluid delivered from the pump; and a pressure compensated flow control valve connected between the pump and each of the actuators, for controlling a flow rate of the hydraulic fluid supplied to each actuator in response to an operation signal from control means, wherein the control system comprises a first detection device for detecting a differential pressure between the delivery pressure of the pump and the maximum load pressure among the plurality of hydraulic actuators; a second detection device for detecting the delivery pressure of the pump; a first device for calculating, based on a differential pressure signal from the first detection means, a differential pressure target delivery amount $Q\Delta p$ of the pump to hold the differential pressure constant; a second device for calculating an input limiting target delivery amount QT of the pump based on at least a pressure signal from the second detection device an an input limiting function preset for the pump; a third device for selecting one of the differential pressure target delivery amount $Q\Delta p$ and the input limiting target delivery amount QT as a delivery amount target value Qo for the pump, and then controlling the delivery amount of the pump such that the delivery amount does not exceed above the input limiting target delivery amount QT; and a fourth device for calculating a compensation value Qns to limit a total consumable flow rate for the actuator based on at least the input limiting target delivery amount QT and the differential pressure target delivery amount $Q\Delta p$ when the input limiting target delivery amount QT is selected by the third device, and then controlling the pressure compensated flow control valve based on the compensation value Qns.

The fourth device may control a pressure balance valve of the pressure compensated flow control valve based on the compensation value Qns. Alternatively, the fourth device may calculate an operation signal modifying factor $\alpha$ from the compensation value Qns, modify the operation signal from the control means using the operation signal modifying factor $\alpha$, and control the pressure compensated flow control valve using the corrected operation signal.

The third device may select smaller one of the differential pressure target delivery amount $Q\Delta p$ and the input limiting target delivery amount QT as the delivery amount target value Qo for the pump. Alternatively, the third device may select the differential pressure target delivery amount $Q\Delta p$ as the delivery amount target value Qo for the pump when the compensation value Qns is zero, and the input limiting target delivery amount QT as the delivery amount target value Qo for the pump when the compensation value Qns is not zero.

The fourth device may include an adder device to determine a target delivery amount deviation $\Delta Q$ as a deviation between the differential pressure target delivery amount $Q\Delta p$ and the input limiting target delivery amount QT, and calculate the compensation value Qns using at least the target delivery amount deviation $\Delta Q$.

In this case, the fourth device may further include an integral type calculation device to calculate an increment $\Delta Qns$ of the compensation value Qns from the target delivery amount deviation $\Delta Q$ for making that deviation zero, and then add the increment $\Delta Qns$ to a previously calculated compensation value $Qns-1$ to determine the compensation value Qns, and limiter means for generating $Qns=0$ when the compensation value Qns is a negative value.

The first device may include an adder device to calculate a differential pressure deviation $\Delta P'$ between the differential pressure signal from the first detection device and the preset target differential pressure, and the fourth device may further include a filter device for outputting zero when the differential pressure deviation ΔP' is positive and a value ΔP'' equal to the differential pressure deviation ΔP' when it is negative, a selector device for selecting an output ΔP'' of the filter device when the target delivery amount deviation ΔQ is negative and the output ΔP' of the adder device when the target delivery amount deviation ΔQ is positive, and a calculation device for calculating the compensation value Qns from the value ΔP'' or ΔP' selected by the selector device.

The fourth means may calculate a deviation between the compensation value Qns and a preset offset value, and then output a resulting value Qnso as the final compensation value.

Furthermore, the first device may comprise an integral type calculation device which calculates, based on the differential pressure signal from the first detection device, an increment ΔQΔp of the differential pressure target delivery amount QΔp for holding the differential pressure constant, and then adds the increment ΔQΔp to the previously calculated differential target delivery amount Qo−1 for determining the differential pressure target delivery amount QΔp; second device may comprise an integral type calculation device which calculates an increment ΔQps of the input limiting target delivery amount QT for controlling the pressure signal from the second detection device to a target delivery pressure Pr obtained from the input limiting function of the pump. It then adds the increment ΔQps to the previously calculated input limiting target delivery amount Qo−1 for determining the input limiting target delivery amount QT.

The third device may comprise means for selecting one of the increment ΔQΔp of the differential pressure target delivery amount QΔp and the increment ΔQps of the input limiting target delivery amount QT for selecting one of the differential pressure target delivery amount QΔp and the input limiting target delivery amount QT.

In addition, the input limiting function of the second device may be an input torque limiting function with one of the delivery pressure and the input limiting target delivery amount of the pump as a parameter, and the second device may calculate the input limiting target delivery amount QT of the pump based on both the pressure signal of the second detection device and the input torque limiting function. Alternatively, the control system may further include third detection device for determining a deviation between the target speed and the actual speed of a prime mover for driving the pump; and the input limiting function of the second device may be an input torque limiting function with one of the delivery pressure and the input limiting target delivery amount of the pump and the speed deviation of the prime mover as parameters, and the second device may calculate the input limiting target delivery amount QT of the pump based on the pressure signal of the second detection device, the speed deviation signal of the third detection device and the input torque limiting function.

With the present invention thus arranged, when the differential pressure target delivery amount QΔp is selected as the delivery amount target value Qo by the third device, the delivery amount of the pump is controlled such that the differential pressure between the delivery pressure of the pump and the maximum load pressure among the plurality of hydraulic actuators becomes equal to the differential pressure target delivery amount QΔp. At this time, since the input limiting target delivery amount QT is not selected by the third device, the fourth device will not calculate the compensation value Qns, and the total consumable flow compensating control for restricting the flow rate through the flow control valve will not be performed.

When the input limiting target delivery amount QT is selected as the delivery amount target value Qo by the third device, the delivery amount of the pump is controlled while being limited such that it becomes equal to the input limiting target delivery amount QT. At this time, since the input limiting target delivery amount QT is selected by the third device, the fourth device calculates the compensation value Qns, and the total consumable flow compensating control is performed for restricting the flow rate through the flow control valve.

Thus, according to the present invention, the differential pressure target delivery amount QΔp and the input limiting target delivery amount QT are independently calculated as the target delivery amount Qo for the pump, and the total consumable flow compensating control is carried out only when the input limiting target delivery amount QT is selected. Therefore, the load-sensing control and the total consumable flow compensating control will not occur simultaneously. Specifically, in the condition where the delivery amount of the pump is less than its available maximum delivery amount (the input limiting target delivery amount QT), the load-sensing control is carried out, while in the condition where it reaches the available maximum delivery amount, the total consumable flow compensating control is carried out. This enables smooth increases or decreases in the flow rates supplied to the respective hydraulic actuators and hence improve the operability. It is also possible to prevent a hunting phenomenon due to interference between the load-sensing control and the total consumable flow compensating control, resulting in the stable control.

In the present invention, where the fourth device is designed to control the pressure balance valve of the pressure compensated flow control valve using the compensation value Qns, the consumable flow rate which is passed through the pressure compensated flow control valve to the associated hydraulic actuator is determined based on both a throttle opening command value for a flow control valve given by the operation signal from the control means, and a differential pressure command value across the flow control valve given to the pressure balance valve in the form of the compensation value Qns from the fourth device. On the contrary, where the operation signal modifying factor α is calculated from the compensation value Qns and the operation signal from the control device is modified using the operation signal modifying factor α to control the pressure compensated flow control valve, the above differential pressure command value is included in the throttle opening command value for the flow control valve given by the modified operation signal, and the consumable flow rate is determined by the modified operation signal (throttle opening command value).

With the first and second calculation device being of the integral type, the new target delivery amount Qo is always calculated from the preceding target delivery amount Qo−1 and the transition is hence smoothed when the pump is shifted from the condition where it is controlled following the differential pressure target delivery amount QΔp to the condition where it is controlled following the input limiting target delivery amount QT, or vice versa. As a result, the pump will not be subjected to rush operation at the time of shifting the control mode, and more stable control is ensured.

Further, where the fourth device calculates a deviation between the compensation value Qns and the preset offset value and outputs the resulting value Qnso as the final compensation value. Also the total consumable flow rate determined by the pressure compensated flow control valve under control using Qnso becomes slightly greater than the available maximum delivery amount of the pump by an extent corresponding to the offset value, and hence there produces a corresponding free flow rate in the delivery amount of the pump, which can pass into the hydraulic actuator(s) on the lower pressure side. In this case too, however, most of the flow rate is under the total consumable flow compensating control, which ensures a function to certainly supply the hydraulic fluid to the actuator(s) on the higher pressure side as well, for achieving the combined operation. Existence of such a free flow rate provides some degree of freedom in the total consumable flow compensating control and can be utilized advantageously. For example, in one application of straight travelling with two track motors where it is desired for the respective load pressures to affect each other, the free flow rate passes into the track motor on the lower pressure side, and the straight travelling can be effected with certainty. As a result, the drawback as would be experienced in the strict total consumable flow compensating control can be eliminated.

Moreover, in the total consumable flow compensating control of the prior art (DE-A1-3422165), because the pressure compensated flow control valve is hydraulically controlled directly with the differential pressure between the delivery pressure of the pump and the maximum load pressure among the actuators, as mentioned above, the total consumable flow rate is coincident with the actually consumed total flow rate. On the contrary, in the total consumable flow compensating control of the present invention, the pressure compensated flow control valve is controlled using a calculated value and hence the total consumable flow rate can be selected optionally. For example, as set forth above, it is possible to make a control system such that the total consumable flow rate becomes larger than the delivery amount of the pump. In this case, the total consumable flow rate can exceed the actually consumed total flow rate. In addition, while the throttle openings of the respective pressure balance valves are reduced at the same proportion in the prior art, the present invention is applicable to not only such a mode, but also another mode in which the throttle openings of the respective pressure compensated flow control valves are reduced to be slightly different from each other.

DETAILED DESCRIPTION OF THE PREFERRED EMBODIMENTS

A preferred embodiment of the present invention will be described below with reference to the drawings.

Figure 1:
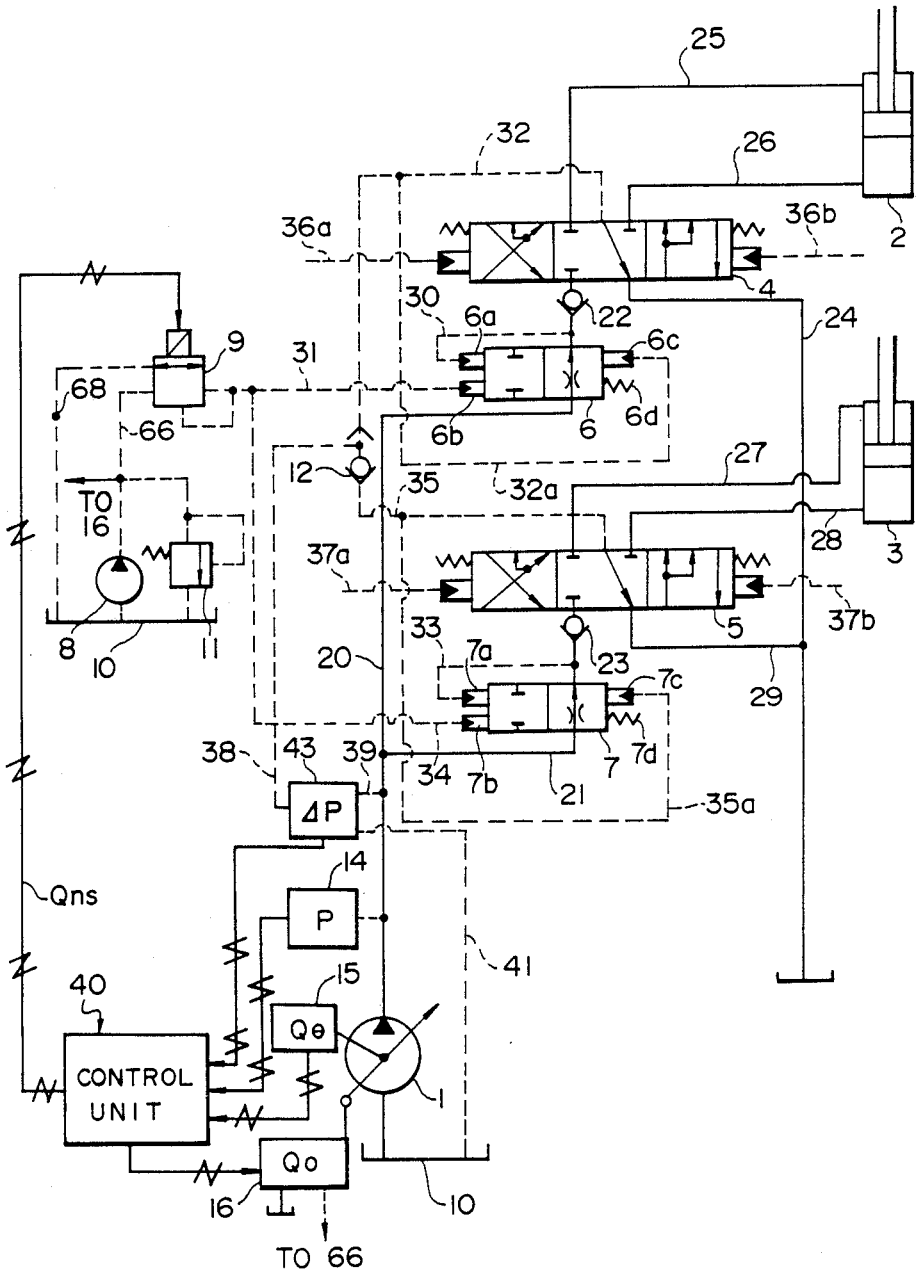
FIG. 1 is a schematic view showing a control system for a hydraulic drive circuit according to one embodiment of the present invention, including the hydraulic drive circuit itself.

FIG. 1 shows an overall arrangement of a load-sensing hydraulic drive circuit and a control system of the present invention. The load-sensing hydraulic drive circuit will first be explained. This hydraulic drive circuit comprises a variable displacement hydraulic pump 1 of the swash plate type, for example, first and second hydraulic actuators 2 and 3, driven by hydraulic fluid delivered from the hydraulic pump 1, a first flow control valve 4 and a first pressure balance valve 6 for pressure compensation both disposed between the pump 1 and the first actuator 2 to control the flow rate and direction of hydraulic fluid supplied to the first actuator 2 from the pump 1, and a second flow control valve 5 and a second pressure balance valve 7 for pressure compensation both disposed between the pump 1 and the second actuator 3 to control the flow rate and direction of hydraulic fluid supplied to the second actuator 3 from the pump 1.

The first pressure balance valve 6 is connected at its inlet side to the pump 1 through a hydraulic fluid supply line 20, and at its outlet side to the flow control valve 4 through a line with a check valve 22. The flow control valve 4 is connected at its inlet side to the pressure balance valve 6 and also to a tank 10 through a return line 24, and at its outlet side to the first actuator 2 through main lines 25, 26.

The second pressure balance valve 7 is connected at its inlet side to the pump 1 through a line 21 and the hydraulic fluid supply line 20, and at its outlet side to the flow control valve 5 through a line with a check valve 23. The flow control valve 5 is connected at its inlet side to the pressure balance valve 7 and also to the tank 10 through a return line 29, and at its outlet side to the second actuator 3 through main lines 27, 28.

The pressure balance valve 6 is of a pilot operated type having two closing-direction working pilot pressure chambers **6*a*, 6*b* and an opening-direction working pilot chamber 6*c* located in opposite relation. The inlet pressure of the flow control valve 4 is applied to the closing-direction working-pilot pressure chamber 6*a* through a line 30, the outlet pressure of a proportional solenoid valve 9 (later described) is applied to the other pressure chamber 6*b* through a line 31, and the pressure (later described) between the flow control valve 4 and the first actuator 2 is applied to the opening-direction working pilot pressure chambers 6*c* through a line 32*a*. The pressure balance valve 6 further includes a spring 6*d* for urging the valve 6** in the opening direction.

The pressure balance valve 7 is also constructed in a like manner. More specifically, the pressure balance valve 7 is of a pilot operated type having two closingdirection working pilot pressure chambers **7*a*, 7*b* and an opening-direction working pilot chamber 7*c* located in opposite relation. The inlet pressure of the flow control valve 5 is applied to the closing-direction working pilot pressure chambers 7*a*, through a line 33, the outlet pressure of the proportional solenoid valve 9 is applied to the other pressure chamber 7*b* through a line 34, and the pressure between the flow control valve 5 and the second actuator 3 is applied to the openingdirection working pilot pressure chambers 7*c* through a line 35*a*. The pressure balance valve 7 further includes a spring 7*d* for urging the valve 7** in the opening direction.

The pressure balance valve 6 operates as follows. When the pressure of the proportional solenoid valve 9 is 0 (zero), the pressure balance valve 6 is subjected to the inlet pressure of the flow control valve 4 introduced to its pilot chamber **6*a* through the line 30, in one direction, and to the outlet pressure of the flow control valve 4 introduced to its pilot chamber 6*c* through the line 32*a* and the resilient urging force of the spring 6*d*, in the opposite direction. Therefore, the pressure balance valve 6 always controls the flow rate from the pump 1 so that the differential pressure between the inlet pressure and the outlet pressure of the flow control valve 4 is held a a constant value corresponding to the resilient urging force of the spring 6*d*. As a result, the flow rate through the flow control valve 4 remains unchanged despite fluctuations in the differential pressure between the the delivery line 20 of the pump 1 and the main line 25 or 26 of the actuator 2. Thus, the pressure balance valve 6 functions as a flow control valve for pressure compensation. The pressure balance valve 7** also operates in a like manner.

Meanwhile, when the proportional solenoid valve 9 produces a pressure, this pressure is transmitted to the pressure balance valves 6, 7 through the lines 31, 34 and acts to counter the resilient urging forces of the opposing springs **6*d*, 7*d*. Stated otherwise, the pressure balance valves 6, 7 are each controlled so as to reduce the differential pressure between the inlet pressure and the outlet pressure of the flow control valves 4, 5 in proportion to a pressure rise in lines 31 and 34, and hence the flow rate through the flow control valves 4, 5 is reduced. Thus, controlling the pressure of the proportional solenoid valve 9 makes it possible to restrict the flow rates through the flow control valves 4, 5** and carry out total consumable flow compensating control thereof.

In the illustrated embodiment, the flow control valves 4 and 5 are of a pilot operated type having opposed pilot chambers connected to pilot lines **36*a*, 36*b* and 37*a*, 37*b***, respectively, and are controlled with pilot pressures transmitted through pilot lines in response to operation signals from the respective control levers (not shown).

Here, the flow control valve 4 and the pressure balance valve 6 jointly constitute a single pressure compensated flow control valve. The operation signal from the associated control lever (not shown) gives a throttle opening command value for the flow control valve 4, while the pressure applied to the pressure balance valve 6 from the proportional solenoid valve 9 and the setting value of the spring **6*d* give a command value for the differential pressure across the flow control valve 4. The throttle opening command value and the differential pressure command value for the flow control valve 4 determine a consumable flow rate that is to be passed from the pressure compensated flow control valve 4 to the hydraulic actuator 2**, and the throttle opening of the flow control valve and the throttle opening of the pressure balance valve are so controlled as to achieve the consumable flow rate. The actual flow rate through the pressure compensated flow control valve, that is, the consumed flow rate through the hydraulic actuator, is thus controlled.

The flow control valve 5 and the pressure balance valve 7 jointly constitute another pressure compensated flow control which operates in a like manner.

Also connected to the flow control valves 4, 5 are pilot lines 32, 35 for picking up the load pressures of the first and second actuators 2, 3, respectively. The pilot lines 32, 35 are arranged such that they are connected in the interior of the flow control valves 4, 5 to the return lines 24, 29 in a neutral state and to the main lines of the actuators 2, 3 coupled to the pump 1 in an operated state.

The higher one of the pressures in the lines 32, 35 is selected by a higher-pressure selector valve 12 and then introduced to a differential pressure gauge 43 through a line 38. Further introduced to the differential pressure gauge 43 is the delivery pressure of the pump 1 through a line 39. The differential pressure gauge 43 detects the differential pressure between the delivery pressure of the pump 1 and the higher load pressure (maximum load pressure), and then outputs a differential pressure signal $\Delta P$.

Figure 2:
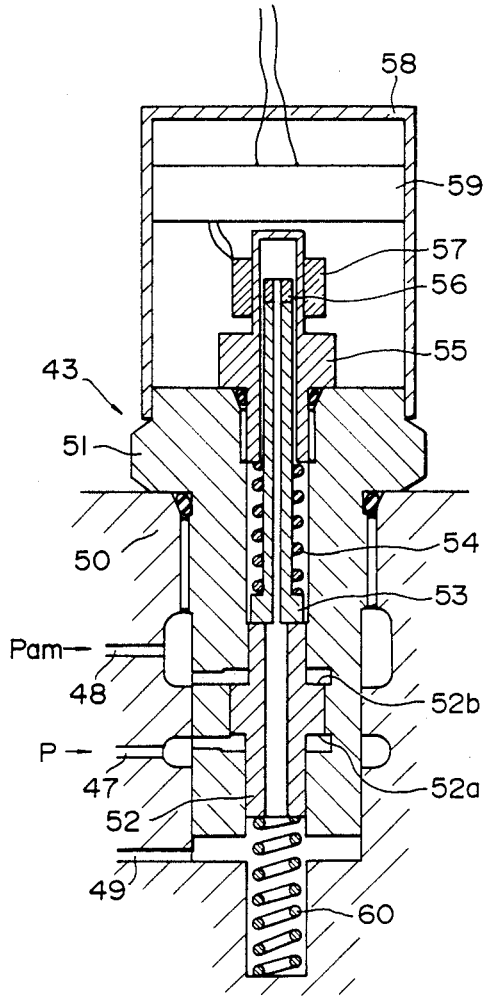
FIG. 2 is a sectional view showing the structure of a differential pressure gauge for the control system.

The differential pressure gauge 43 has such a construction as shown in FIG. 2 by way of example. The differential pressure gauge 43 includes a body 50 having hydraulic fluid supply ports 47, 48 connected to the lines 38, 39, respectively, and a hydraulic fluid discharge port 49 connected to the tank 10 through a line 41, a cylinder 51 fitted in the body 50, a piston 52 accommodated in the cylinder 51 and having two pressure receiving surfaces 52*a*, 52*b* of equal area which are opposite to each other and subjected to the different pressures from the supply ports 47, 48, respectively, a shaft 53 made of a non-magnetic substance and transmitting a displacement and force of the piston 52, a spring 54 accommodated in the cylinder 51 for receiving the force of the piston 52 and giving a displacement proportional to the received force to the piston 52, a case 55 made of a non-magnetic substance and fitted to the cylinder 51, a core 56 made of a magnetic substance, attached to the distal end of the shaft 53 and accommodated in the case 55 for being displaced in the case 55 through the same distance as that of the piston 52, a displacement sensor 57 fixed to the outer periphery of the case 55 for converting the displacement of the core 56 to an electric signal, an amplifier 59 accommodated in a cover 58 attached to the cylinder 51 for amplifying the electric signal from the displacement sensor 57 and issuing the amplified signal to the outside, and a spring 60 disposed between the piston 52 and the body 50.

In the differential pressure gauge 43 thus constructed, the pump delivery pressure P and the maximum load pressure Pam act on the pressure receiving surfaces 52*a*, 52*b* of the piston 52 through the supply ports 47, 48, respectively. Letting the pressure receiving area to be A, the force of $A\times(P-Pam)$ acts on the piston 52 upward in the figure because of $P>Pam$. That force causes the piston 52 to be displaced against the springs 54, 60 which are in their pre-compressed state to resiliently support the piston 52, so does the core 56. Assuming that the springs 54, 60 have their spring constants K1, K2, the displacement S is expressed by:

$$S=A\times(P-Pam)/(K1-K2)$$

The displacement sensor 57 converts the displacement to an electric signal, and the amplified signal is output from the amplifier 59. The displacement sensor 57 is preferably of a contactless type such as a differential transformer type or magnetic resistor element type, for example, because of the presence of oil deposited around the core 56. For this reason, the shaft 53 and the case 55 are both made of a non-magnetic substance. Advantageously, the displacement sensor of any such type has a linear relationship between the displacement S and an electric signal level E, i.e., a simple proportional relationship. Letting the proportional constant to be K, therefore, the electric signal level E is expressed by:

$$E=K\cdot S=\{K\cdot A/(K1-K2)\}(P-Pam)$$

Here, since A, K1 and K2 are all constants, the electric signal level E has a value proportional to the differential pressure (P−Pam) between the pump delivery pressure and the maximum load pressure, thereby providing the differential pressure signal ΔP.

By so acting, the two pressures on the opposite pressure receiving surfaces of the piston 52 produce the differential pressure therebetween, making it is possible to avoid errors caused by non-linearity of the output from the pressure sensor with respect to the pressure and hysteresis upon rise and fall of the pressure. On the other hand, errors would result in the case where the respective pressures are introduced to separate pressure sensors to produce electric signals and the difference in level between those two electric signals is then obtained to produce an electric signal corresponding to the differential pressure. Consequently, the differential pressure can be measured with a high degree of accuracy even under condition of higher pressure.

As an alternative, because the differential pressure gauge 43 is merely needed to measure the differential pressure only in case of $P>Pam$ in the illustrated embodiment, the spring 60 may be dispensed with. In this case, the structure is simplified and the relationship between the output electric signal level E and the differential pressure is expressed by:

$$E=\{K\cdot A/K1\}(P-Pam)$$

Turning back to FIG. 1 connected to the hydraulic fluid supply line 20 of the pump 1 is a pressure detector 14 for detecting the delivery pressure of the pump 1 and producing an output pressure signal P. The pump 1 is provided with an inclination angle gauge 15 which detects an inclination angle of the displacement volume varying mechanism such as a swash plate and outputs an inclination angle signal Qθ. In this embodiment, it is supposed that the pump 1 is controlled substantially constant in the rotational speed thereof, and thus the inclination angle signal Qθ indicates the delivery amount of the pump 1.

The delivery amount of the pump 1 is controlled by a delivery amount controller 16 which is coupled to the displacement volume varying mechanism. The delivery amount controller 16 can be constructed, for example, in the form of an electro-hydraulic servo-type hydraulic drive device as shown in FIG. 3.

More specifically, the delivery amount controller 16 has a servo piston 16*b* which drives a displacement volume varying mechanism 16*a*, such as a swash plate, swash shaft or the like, of the variable displacement hydraulic pump 1, the servo piston 16*b* being accommodated in a servo cylinder 16*c*. A cylinder chamber of the servo cylinder 16 is divided by a servo piston 16*b* into a left-hand chamber 16*d* and a righthand chamber 16*e*, and the lefthand chamber 16*d* is formed to have the cross-sectional area D larger than that d of the righthand chamber 16*e*.

Designated at 8 is the pilot pump or hydraulic source for supplying hydraulic fluid to the servo cylinder 16*c*. The hydraulic source 8 and the lefthand chamber 16*d* of the servo cylinder 16*c* is intercommunicated through a line 16*f*, and the hydraulic source 8 and the righthand chamber 16*e* of the servo cylinder 16*c* is intercommunicated through a line 16*i*. These lines 16*f* and 16*i* are communicated to the tank 10 through a return line 16*j*. A solenoid valve 16*g* is disposed in the line 16*f* intercommunicating the hydraulic source 8 and the lefthand chamber 16*d* of the servo cylinder 16*c*, and another solenoid valve 16*h* is disposed in the return line 16*j*. These solenoid valves 16*g*, 16*h* are normally-closed solenoid valves, automatically returning to a closed state when deenergized, and their state is switched by a load-sensing control signal Q'o from a control unit 40, described later.

Figure 3:
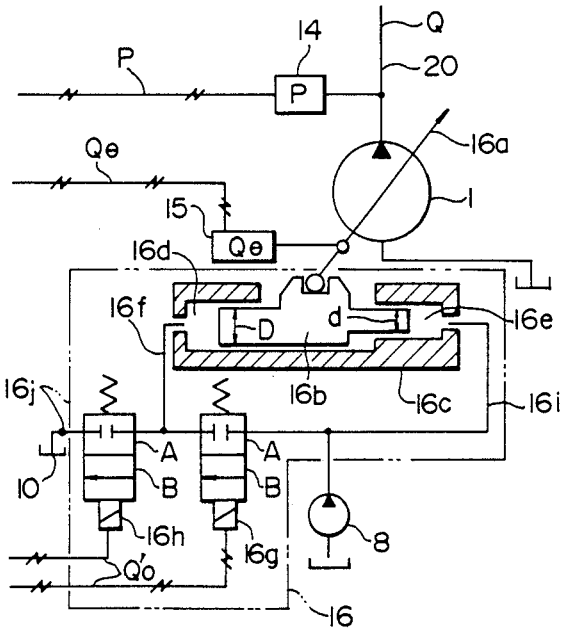
FIG. 3 is a schematic view showing the configuration of a delivery amount control device in the control system.

With the above construction, when the solenoid valve 16*g* is energized (turned on) and brought into a switched position B, the lefthand chamber 16*d* of the servo cylinder 16*c* is communicated with the hydraulic source 8, so that the servo piston 16*b* is moved rightward as viewed in FIG. 3 due to the difference in area between the lefthand chamber 16*d* and the righthand chamber 16*e*. This makes the inclination angle of the displacement volume varying mechanism 16a of the pump 1 larger, thereby increasing the delivery amount thereof. When the solenoid valves 16g and 16h are both deenergized (turned off) for being returned to their switched positions A, the fluid path leading to the lefthand chamber 16d is cut off and the servo piston 16b is kept at that shifted position in a stand-still state. As a result, the inclination angle of the displacement volume varying mechanism 16a of the pump 1 is held constant and hence the delivery amount thereof is also held constant. On the other hand, when the solenoid valve 16h is energized (turned on) for being brought into a switched position B, the lefthand chamber 16d of the servo cylinder 16c is communicated with the tank 10, so that the servo piston 16b is moved leftward in FIG. 3 under the action of the pressure in the righthand chamber 16e upon reduction of the pressure in the lefthand chamber 16d. This makes the inclination angle of the displacement volume varying mechanism 16a of the pump 1 smaller, thereby decreasing the delivery amount thereof.

By on-off controlling the solenoid valves 16g, 16h to regulate the inclination angle of the pump 1 in this manner the inclination angle signal Qθ output from the inclination angle gauge 15 is controlled to have a level corresponding to a target delivery amount Qo calculated by the control unit 40, as described later.

Figure 4:
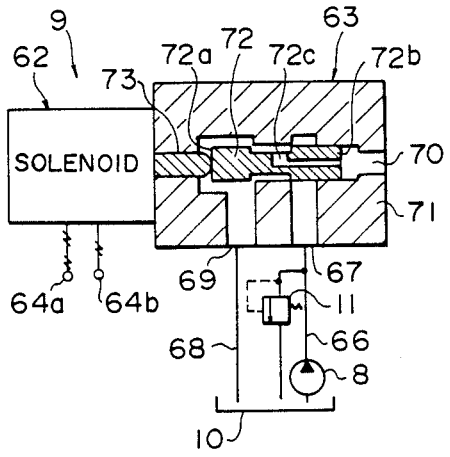
FIG. 4 is a sectional view showing the structure of a proportional solenoid valve in the control system.

The proportional solenoid valve 9 can be constructed, for example, as shown in FIG. 4. The illustrated proportional solenoid valve 9 contains by a proportional solenoid pressure-reducing valve, and includes a proportional solenoid part 62 and a pressure-reducing valve part 63. The solenoid part 62 has a known structure comprising a solenoid with terminals 64a, 64b, and an iron core. The input to terminals 64a, 64b is a total consumable flow compensating control signal Qns, described later, from the control unit 40.

The pressure-reducing valve 63 includes a body 71 having a hydraulic supply port 67 connected to an auxiliary pump 8 through a supply line 66, a hydraulic fluid discharge port 69 connected to the tank 10 through a return line 68, and a hydraulic outlet port 70 connected to the pilot lines 31, 34. A spool 72 disposed in the body 71, having end faces 72a, 72b opposite to each other and formed with an internal passage 72c, and a push rod 73 engaging at one end with the iron core of the proportional solenoid part 62 and abutting at the other end against the end face 72a of the spool 72.

When electric current is supplied to the solenoid through terminals 64a, 64b, a force in proportion to a level of the current is induced on the iron core of the solenoid 62 and transmitted to the end face 72a of the spool 72 through the push rod 73 in engagement with the iron core. By the transmitted, force the spool 72 is moved rightward from an illustrated position to communicate the internal passage 72c with the supply port 67 and to communicate the supply port 67 to the outlet port 70. As a result, the hydraulic pressure in the outlet port 70 is increased and the force acting on the end face 72b of the spool 72 is also increased. When the force acting on the end face 72b exceeds the force pressing the push rod 73 (i.e., the force induced on the iron core of the solenoid part 62), the spool 72 moves leftward to communicate the internal passage 72c with the discharge port 69, so that the outlet port 70 and the discharge port 69 are communicated with each other through the internal passage 72c. As a result, the hydraulic pressure in the outlet port 70 is reduced and the force acting on the end face 72b of the spool 72 is also reduced. When the force acting on the end face 72b becomes smaller than the force pressing the push rod 73, the spool 72 is moved rightward again in the figure.

Thus, since the spool 72 of the pressure-reducing valve port 63 is operated while receiving the force induced on the iron core of the solenoid part 62, the pressure having a magnitude in proportion to the current level supplied to the proportional solenoid is produced at outlet port 70 and then output to the pilot chambers 6b, 7b of the pressure balance valves 6, 7 mentioned above.

Incidentally, the pressure in the supply line 66 is designed to always stand at a constant level set by a relief valve 11.

Turning back to FIG. 1 once again, the pressure signal P from the pressure detector 14, the inclination angle signal Qθ from the inclination angle gauge 15, and the differential pressure signal ΔP from the differential pressure gauge 43 are input to the control unit 40 which generates the total consumable flow compensating control signal Qns and the load-sensing control signal Q'o, and then outputs them to the proportional solenoid valve 9 and the delivery amount controller 16, respectively.

Figure 5:
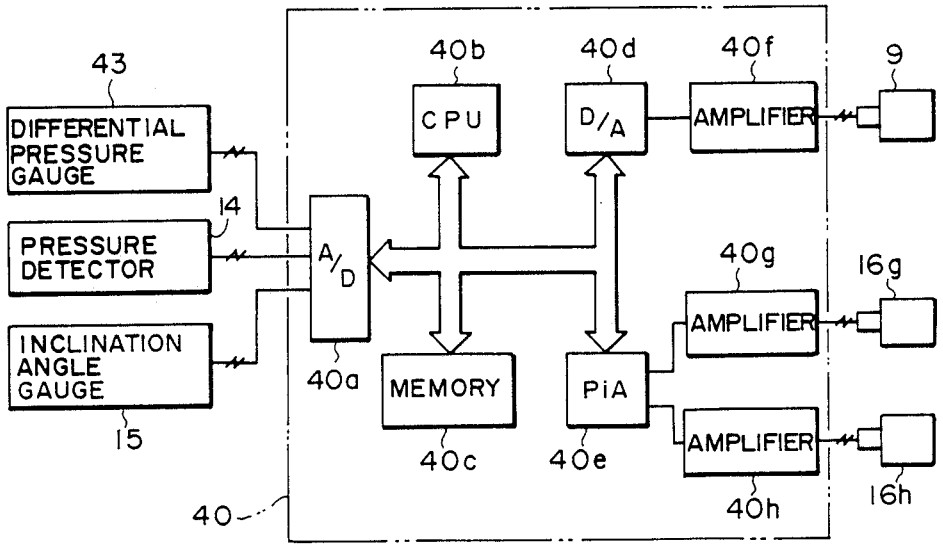
FIG. 5 is a schematic view showing the configuration of a control unit as a main component of the control system.

The control unit 40 comprises a microcomputer and includes, as shown in FIG. 5, an A/D converter 40a for converting the pressure signal P output from the pressure detector 14, the inclination angle signal Qθ output from the inclination angle gauge 15, and the differential pressure signal ΔP output from the differential pressure gauge 43 to respective digital signals. Control unit 40 also comprises a central processing unit 40b, a memory 40c for storing a program for the control procedure, a D/A converter 40d for outputting analog signals, an I/O interface 40e for outputting signals, an amplifier 40f connected to the proportional solenoid valve 9, and amplifiers 40g, 40h connected to the solenoid valves 16g, 16h, respectively.

In response to the pressure signal P output from the pressure detector 14, the inclination angle signal Qθ output from the inclination angle gauge 15, and the differential pressure signal ΔP output from the differential pressure gauge 43, the control unit 40 calculates a delivery amount target value Qo for the variable displacement hydraulic pump 1 based on the control program stored in the memory 40c, and then outputs the loadsensing control command signal Q'o from the amplifiers 40g, 40h to the solenoid valves 16g, 16h of the delivery amount control 16, respectively, through the I/O interface 40e. As the delivery amount controller 16 receives signal Q'o, the position of the servo piston 3 is controlled by on-off servo control using an electrohydraulic servo technique so that the inclination angle signal Qθ has a level corresponding to the delivery amount target value Qo, as explained above. The control unit 40 also calculates a total consumable flow compensating value based on a control program stored in the memory 40c, and outputs the control command signal Qns from the amplifier 40f to the solenoid proportional control valve 9 through the D/A converter 40d. This causes the proportional solenoid valve 9 to produce a pressure in proportion to the command signal Qns, as explained above.

Figure 6:
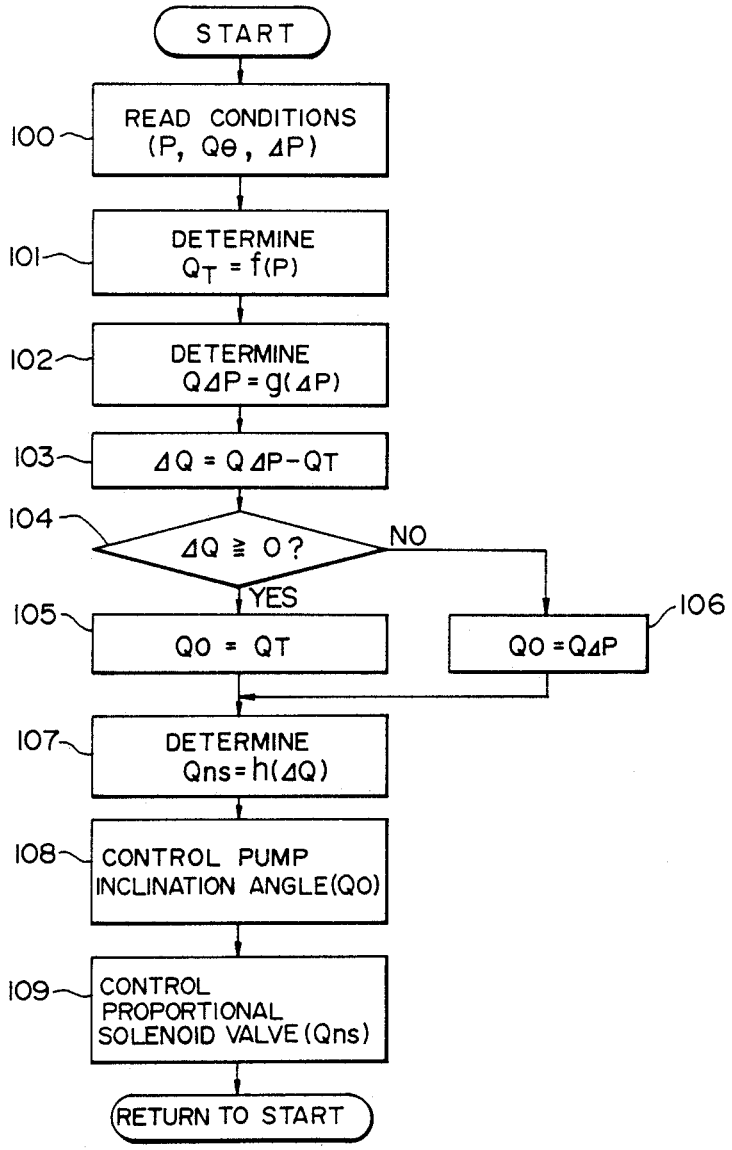
FIG. 6 is a flowchart showing control programs used in the control unit.

There will now be described, with reference to FIG. 6, the processing procedures to be followed for performing load-sensing control, stored in memory 40c of the control unit 40 (i.e., calculation of the delivery amount target value Qo) are illustrated in the flowchart of FIG. 6. They are performed by controlling the delivery amount of the hydraulic pump 1 through the delivery amount control 16, and the processing to perform total consumable flow compensating control (i.e., calculation of the total consumable flow compensation value Qns), and by controlling the pressure balance valves 6, 7 through the proportional solenoid valve 9, under control of the control unit 40.

In a first step 100, the control unit 40 reads and stores therein, as conditions of the hydraulic drive system, the delivery pressure P of the pump 1, the inclination amount Qθ of the pump 1, and the differential pressure ΔP between the maximum load pressure Pam and the delivery pressure P from the outputs of the pressure detector 14, the inclination angle gauge 15 and the differential pressure gauge 43, respectively.

Figure 7:
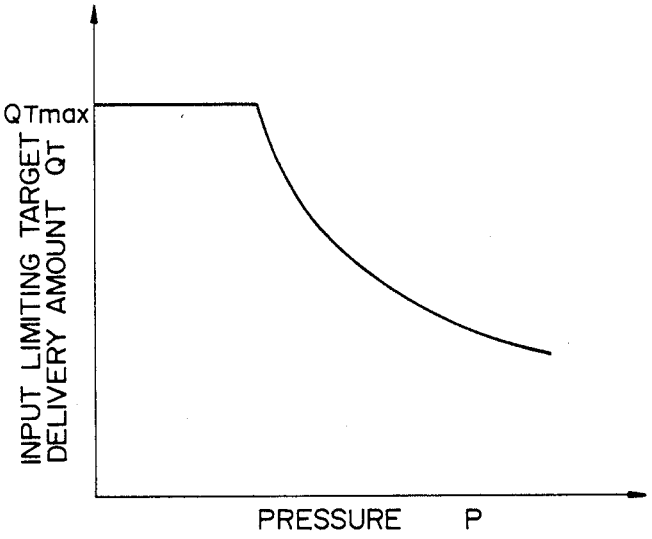
FIG. 7 is a graph showing an input torque limiting function used for determining an input limiting target value.

In a next step 101, an input limiting target delivery amount QT is determined based on both the output pressure P of the pressure detector 14 and an input torque limiting function f(P) previously input in the memory. FIG. 7 shows the input torque limiting function. In FIG. 7, the X-axis represents the output pressure P and the Y-axis represents the input limiting target delivery amount QT based on the input torque limiting function f(P). The input torque of the pump 1 is in proportion to the product of the delivery pressure P and the inclination amount Qθ of the pump 1. Accordingly, the input torque limiting function f(P) is given by a hyperbolic curve or an approximate hyperbolic curve. Thus, f(P) is such a function as expressed by the following equation:

$$QT = \kappa \cdot TP/P \tag{1}$$

where
TP: input limiting torque
κ: proportional constant

Based on the above input torque limiting function f(P) and the delivery pressure P, the input limiting target delivery amount QT can be determined.

Figure 8:
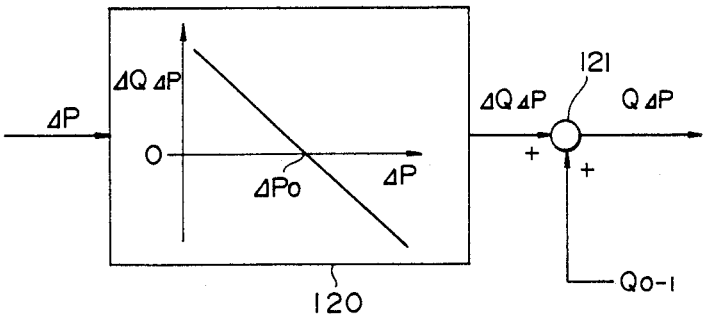
FIG. 8 is a block diagram showing the procedure of determining a differential pressure target delivery amount from the differential pressure between the delivery pressure of a hydraulic pump and the maximum load pressure.

Turning back to step 102 of FIG. 6, the procedure followed subsequent to a step 102 will be explained. In the step the differential pressure signal ΔP of the differential pressure gauge 43 is processed to determine a differential pressure target delivery amount QΔp needed to hold constant the differential pressure between the delivery pressure of the pump 1 and the maximum load pressure among the actuators 2, 3. One example of how to determine the differential pressure target delivery amount QΔp will be explained by referring to FIG. 8. FIG. 8 is a block diagram showing a method of determining the differential pressure target delivery amount QΔp from the differential pressure signal ΔP of the differential pressure gauge 43. In this example, the differential pressure target delivery amount QΔp is determined based on the following equation:

$$\begin{aligned} Q\Delta p &= g(\Delta p) = \Sigma\, KI(\Delta Po - \Delta P) \\ &= KI(\Delta Po - \Delta P) + Qo - 1 \\ &= \Delta Q\Delta p + Qo - 1 \end{aligned} \tag{2}$$

where
KI: integration gain
ΔPo: target differential pressure
Qo−1: delivery amount target value output in the preceding control cycle
(ΔQΔP): increment of the differential target delivery amount per one unit of control cycle time More specifically, this example calculates the differential pressure target delivery amount QΔp using an integration control technique applied to a deviation between the target differential value ΔPo and the actual difference pressure. In FIG. 8, a block 120 calculates KI(ΔPo−ΔP) from the differential pressure ΔP for determining an increment ΔQΔp of the differential pressure target delivery amount per one unit of control cycle time, and a block 121 obtains the equation (2) by adding the above ΔQΔp and the delivery amount target value Qo−1 in the preceding control cycle.

Although QΔp has been determined using the integral control technique applied to ΔPo−ΔP in the foregoing embodiment, it may be determined using any other suitable technique. For example, there can be employed the proportional control technique expressed by;

$$Q\Delta p = Kp(\Delta Po - \Delta P) \tag{3}$$

where Kp is a proportional gain or a proportional plus integral control technique can be performed by using the sum of the equations (2) and (3).

By so doing, the differential pressure target delivery amount QΔp is determined in step 102.

Turning back to FIG. 6 again, in step 103, the target delivery amount deviation ΔQ between the differential pressure target delivery amount QΔp and the input limiting target delivery amount QT is determined. A next step 104 determines whether the deviation ΔQ is positive or negative. If the deviation ΔQ is positive, the process goes to step 105 to select QT as the delivery amount target value Qo. If the deviation ΔQ is negative, it goes to step 106 to select QΔp as the delivery amount target value Qo. In other words, the lesser of the differential pressure target delivery amount QΔp and the input limiting target delivery amount QT is selected as the delivery amount target value Qo, so that the delivery amount target value Qo will not exceed the input limiting target delivery amount QT determined by the input torque limiting function f(P).

Figure 9:
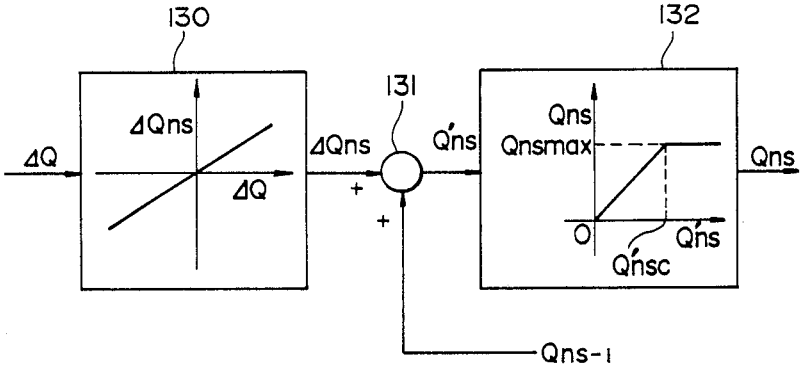
FIG. 9 is a block diagram showing the procedure of determining a total consumable flow compensating current from the target delivery amount deviation.

Then, the process flow goes to step 107. The step 107 calculates the total consumable flow compensation value Qns used for controlling the pressure of the proportional solenoid valve 9 from the target delivery amount deviation ΔQ obtained in step 103. An example of how to determine ΔQ will be described by referring to FIG. 9. FIG. 9 is a block diagram showing a method to calculate the compensation value Qns from the target delivery amount deviation ΔQ. In this example, an compensation value Qns is determined using the integral control technique based on the following equation:

$$\begin{aligned} Qns &= h(\Delta Q) = \Sigma\, KIns \cdot \Delta QPo \\ &= KIns \cdot \Delta Q + Qns - 1 \\ &= \Delta Qns + Qns - 1 \end{aligned} \tag{4}$$

where
KIns: integral gain
Qns−1: total consumable flow compensation value Qns output in the preceding control cycle
ΔQns: increment of the compensation value per one unit of control cycle time More specifically, in block 103 of FIG. 9, the compensation value increment ΔQns per one unit of control cycle time, i.e., KIns·ΔQ, is obtained from the target delivery amount deviation ΔQ determined in step 103. The increment is then added in an adder 131 to the compensation value Qns−1 output in the preceding control cycle, thereby to determine an intermediate value Q'ns. A limiter 132 functions to set Qns=0 if Q'ns<0. When Q'ns≧0, the limiter 132 outputs the compensation value current Qns which is increased in proportion to an increase of Q'ns if Q'ns<Q'nsc (where Q'nsc is a preselected value), and determines the total consumable flow compensation value Qns so as to meet Qns=Qnsmax if Q'ns≧Q'nsc. Here, Qnsmax and Q'nsc are values determined by the maximum inclination angle of swash plate of the pump 1, i.e., the maximum delivery amount thereof.

Although the compensation value Qns has been determined using an integral control technique in the foregoing embodiment, the relationship between Qns and ΔQ may be determined using a proportional control technique or the proportional plus integral control technique, as with the above case of the differential pressure target delivery amount QΔp.

Turning back to FIG. 6 in step 108, the control unit 40 creates the command signal Q'o for the delivery amount control 16 based on the delivery amount target value Qo of pump 1 and the inclination angle signal Qθ output from the inclination angle gauge 15 which are obtained in steps 105, 106, respectively. The command signal Q'o is output to the delivery amount controller 16 through the I/O interface **40*e* and the amplifiers 40*g*, 40*h* of the control unit 40, as shown in FIG. 5, so that the inclination amount Qθ of the pump 1** becomes equal to the delivery amount target value Qo.

Figure 10:
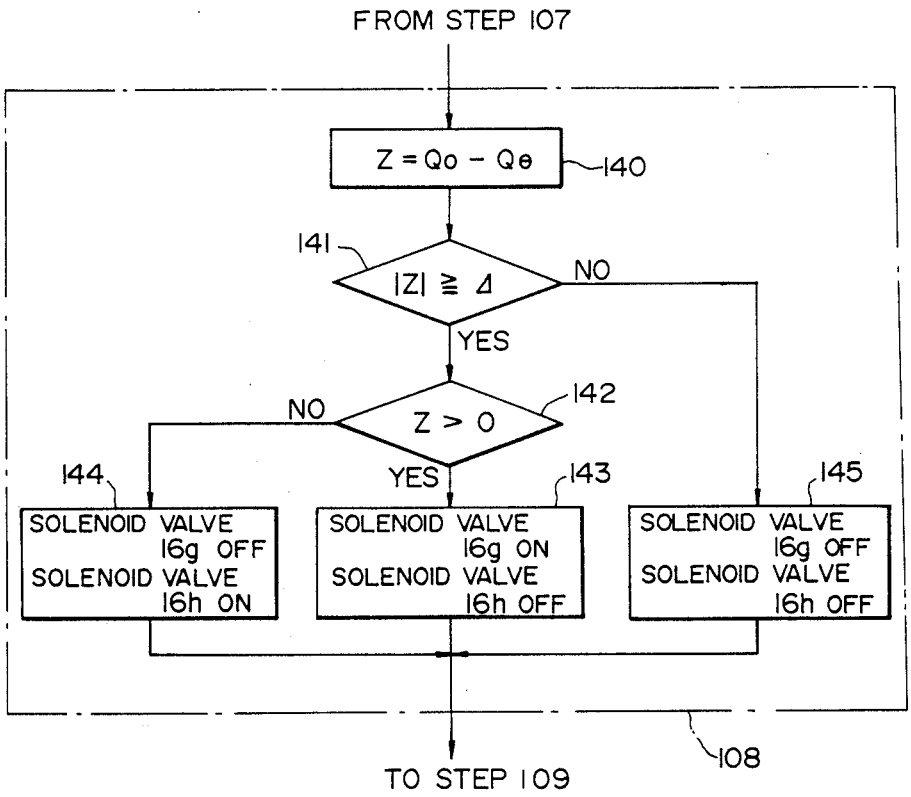
FIG. 10 is a flowchart showing the procedure to control a delivery amount control based on both the delivery amount target value and the inclination angle signal.

FIG. 10 shows a flowchart of the control process carried out in step 108. First, in step 140, Z=Qo−Qθ is calculated to determine a deviation Z between the delivery amount target value Qo and the inclination angle signal Qθ. Then, step 141 determines whether an absolute value of the deviation Z is larger or smaller than a value Δ preset for specifying the dead zone. If the absolute value of the deviation Z is larger than the preset value Δ, the process flow goes to step 142 to determine whether the deviation Z is positive or negative. If the deviation Z is positive, it goes to step 143 for outputting the command signal Q'o which turns ON the solenoid valve **16*g* of the delivery amount control 16 and turns OFF the solenoid valve 16*h* thereof. By so doing, as mentioned above, the inclination angle of the pump 1 is increased so that the inclination angle signal Qθ is controlled to be coincide with the target command signal Qo. If the deviation Z is negative, the process flow goes to step 144 for outputting the command signal Q'o which turns OFF the solenoid valve 16*g* and turns ON the solenoid valve 16*h*. This reduces the inclination angle of pump 1, so that the inclination angle signal Qθ is controlled to be coincide with the target command signal Qo. If the absolute value of the deviation Z is smaller than the preset value Δ, the process flow goes to step 145 where the solenoid valves 16*g* and 16*h* are both turned OFF. This causes the inclination angle of pump 1** to stand constant.

By controlling inclination angle of the pump 1 as explained above, since the differential pressure target delivery amount QΔp is selected as a delivery amount target value Qo in step 106 if the differential pressure target delivery amount QΔp is smaller than the input limiting target delivery amount QT, the delivery amount of the pump 1 is controlled to be equal to the differential pressure target delivery amount QΔp, and the differential pressure between the delivery pressure of the pump 1 and the maximum load pressure out of the plural actuators 2, 3 which is held constant. Thus, the load-sensing control is effected. On the other hand, when the differential pressure target delivery amount QΔp exceeds the input limiting target delivery amount QT, the input limiting target delivery amount QT is selected as a delivery amount target value Qo in the step 105, and therefore the delivery amount of the pump is so controlled as not to exceed the input limiting target delivery amount QT. Thus, the delivery amount of the pump is subjected to input limiting control.

Turning back to FIG. 6, in step 109, an output current to the proportional solenoid valve 9 through the D/A converter **40*d* and the amplifier 40*f* of the control unit 40, as shown in FIG. 5, is controlled to be equal to Qns for controlling the pressure balance valves 6, 7 shown in FIG. 1. With this control, when the differential pressure target delivery amount QΔp is smaller than the input limiting target delivery amount QT and hence there is no need of total consumable flow compensating control, the target current Qns is set 0 in block 132 (FIG. 9) in step 107. When the differential pressure target delivery amount QΔp exceeds the input limiting target delivery amount QT, the target current Qns is increased with an increase of the target delivery amount deviation ΔQ until the maximum value of Qnsmax in step 107, so that the throttle openings of the pressure balance valves 6, 7** are restricted in response to increase of the target delivery amount deviation ΔQ. Thus, the total consumable flow compensating control is effected.

Figure 11:
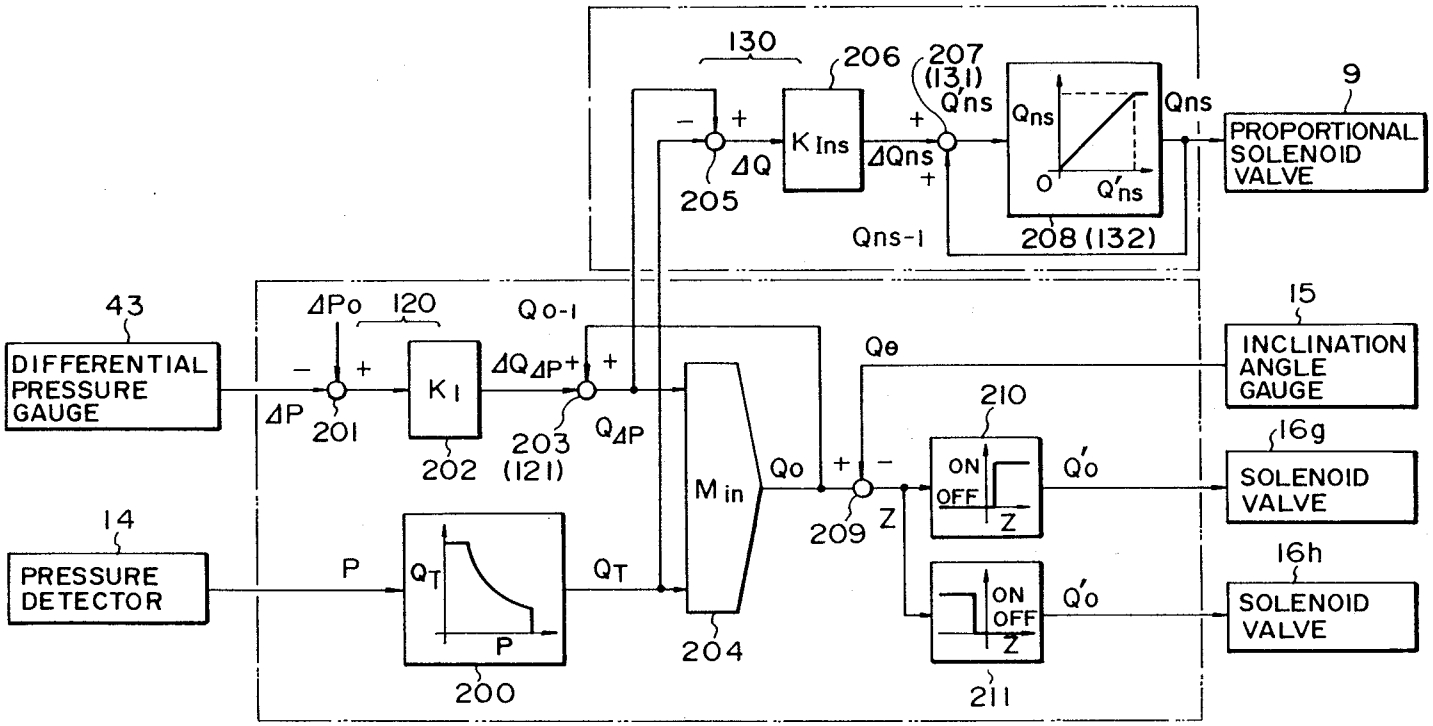
FIG. 11 is a control block diagram showing the entire control procedure.

The foregoing procedure is summarized in FIG. 11 as control block diagram. In the figure, a block 200 corresponds to step 101 in FIG. 6 in that it calculates the input limiting target delivery amount QT based on the input torque limiting function shown in FIG. 7. Blocks 201, 202, 203 correspond to step 102. Specifically, the addition block 201 and the proportional calculation block 202 correspond to the differential pressure target delivery amount increment calculation block 120 in FIG. 8, and the addition block 203 corresponds to the adder 121 in FIG. 8. Thus, the differential pressure target value QΔp is calculated through these three blocks. Block 204 corresponds to steps 104, 105, and 106 in FIG. 6 in that it selects the lesser of the two target delivery amounts QT and QΔp as the delivery amount target value Qo.

Blocks 205, 206, 207, 208 correspond to step 107 in FIG. 6. Specifically, the addition block 205 and the proportional calculation block 206 correspond to the total consumable flow compensation value increment calculation block 131 in FIG. 9, respectively, and the addition block 207 corresponds to the limiter 132 in FIG. 9. The total consumable flow compensation value Qns is calculated through those three blocks. Blocks 209, 210, 211 correspond to step 108 in FIG. 6. Specifically, the addition block 209 corresponds to the step 140 in FIG. 10, and the blocks 210 and 211 correspond to the steps 141–145 in FIG. 10 in outputting the command signals Q'o to the respective solenoid valves **16*g*, 16*h***.

As will be apparent from the foregoing, in the prior art in which the differential pressure ΔP between the delivery pressure of the pump and the maximum load pressure out of the actuators is employed directly to control the pressure balance valves for effecting the total consumable flow compensating control, there has been experienced a disadvantage that the pressure balance valves 6, 7 are operated also in response to a reduction of the differential pressure ΔP caused by a response lag in the delivery amount controller 16 for the pump 1, and total consumable flow compensating control is performed unintentionally before the load-sensing control. On the contrary, in this embodiment, the input limiting target delivery amount QT and the differential pressure target delivery amount QΔp are calculated independently of each other as the target delivery amount Qo of pump 1, and only if the differential pressure target delivery amount QΔp exceeds the input limiting target delivery amount QT, the total consumable flow compensating control is carried out. Therefore, when the differential pressure target delivery amount is smaller than the input limiting target delivery amount and hence there is no need of total consumable flow compensating control, the total consumable flow compensating control will not be carried out even if the differential pressure ΔP is reduced due to a response lag in the delivery amount control 16 for the pump 1. Therefore, the throttle openings of the pressure balance valves 6, 7 will not be restricted. Consequently, the flow control valves 4, 5 can provide the flow rates as exactly specified by the associated control levers. Further, the load-sensing control and the total consumable flow compensating control are not effected concurrently, and this prevents a hunting phenomenon from occurring due to interference therebetween, and hence ensures stable control of the hydraulic actuators 2, 3.

Note that although the above embodiment has been described as using ON/OFF solenoid valves in the delivery amount control 16, usual proportional solenoid valves or servo valves may instead be employed for control in an analog manner.

Figure 12:
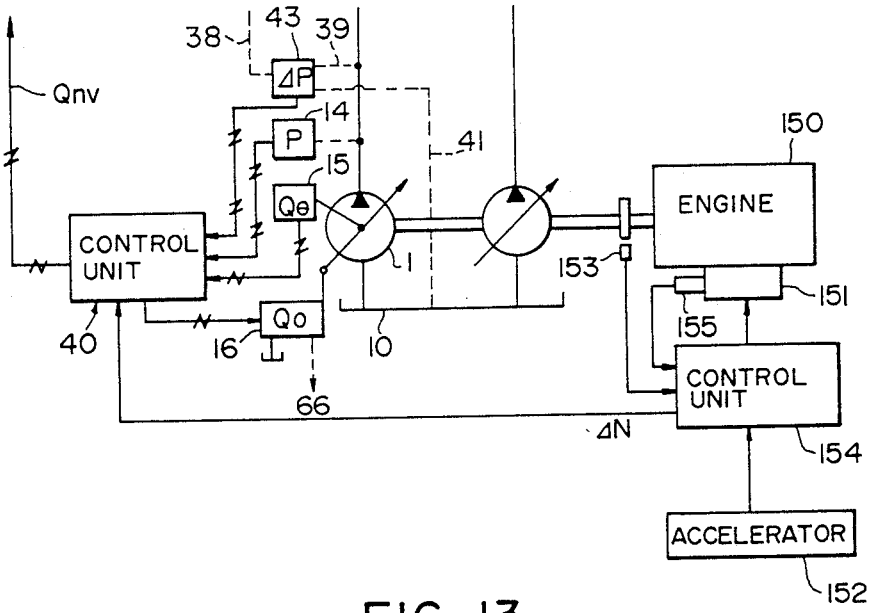
FIG. 12 is a schematic view showing a control system according to a second embodiment of the present invention.
Figure 13:
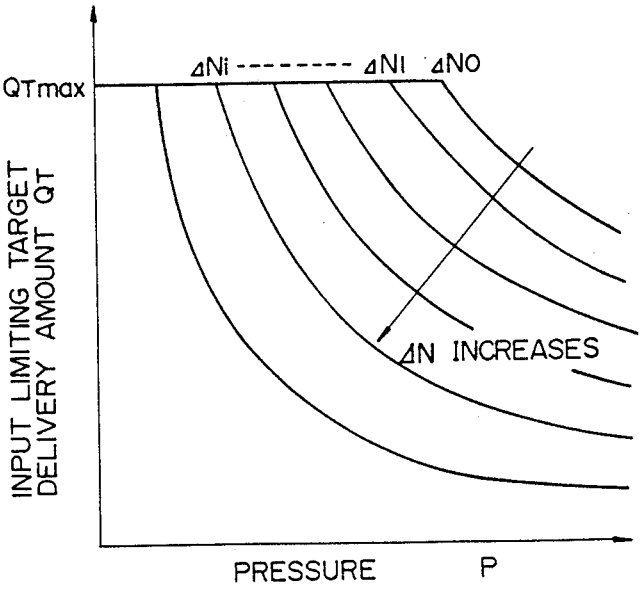
FIG. 13 is a graph showing an input torque limiting function used in the control system of FIG. 12.

Also, in calculation of the input limiting target delivery amount QT in the above embodiment, QT has been determined from the delivery pressure P and the input torque limiting function f(P). But, as an alternative embodiment of the present invention, it is also possible to determine a speed deviation ΔN between the target speed set by an accelerator of a prime mover for driving the pump and the actual speed of the prime mover. It is also possible to employ, as the input limiting function for the pump, an input torque limiting function f1(P, ΔN) with parameters of the delivery pressure P of the pump 1 and the speed deviation ΔN of the prime mover, thereby determining QT based on the speed deviation ΔN, the delivery pressure P and the input torque limiting function f1(P, ΔN), as disclosed in EP-B1-0062072. FIGS. 12 and 13 show such an embodiment in which the identical members to those in FIG. 1 are designated with the same reference numerals.

In FIG. 12, an internal combustion engine 150 for driving a plurality of pumps including a hydraulic pump 1 is shown. Fuel is supplied to engine 150 by a fuel injection pump 151. The target speed for engine 150 is set by an accelerator 152. The engine 150 has a speed sensor 153 on its output shaft which detecting rotational speed . A target engine speed signal Nr from accelerator 152 and an actual engine speed signal Ne from the speed sensor 153 are input to a control unit 154 for the engine 150 for determining an engine speed deviation ΔN therebetween. Also input to the control unit 154 is a rack displacement signal from a rack displacement detector 155 for the fuel injection pump 151. Based on the engine speed deviation ΔN and the rack displacement signal, the control unit 154 calculates a target rack displacement for the fuel injection pump 151 and then outputs a rack operating signal to the fuel injection pump 151. Further, the control unit 154 outputs the engine speed deviation ΔN to the control unit 40 for the hydraulic pump 1 as well.

The control unit 40 stores therein, as the input limiting function for the pump 1, an input torque limiting function f1(P, ΔN) with parameters of the delivery pressure P of the pump 1 and the engine speed deviation ΔN of the internal combustion engine 150. FIG. 13 shows the input torque limiting function f1(P, ΔN). The input torque limiting function f1(P, ΔN) reduces the product of the target delivery amount QT and the delivery pressure P as the engine speed deviation ΔN is increased, thereby controlling the target delivery amount QT.

In control unit 40, the input limiting target delivery amount QT is determined based on the engine speed deviation ΔN, the delivery pressure P and the input torque limiting function f1(P, ΔN). By so doing, the torque of pump 1 can be reduced with the increasing engine speed deviation ΔN.

Figure 14:
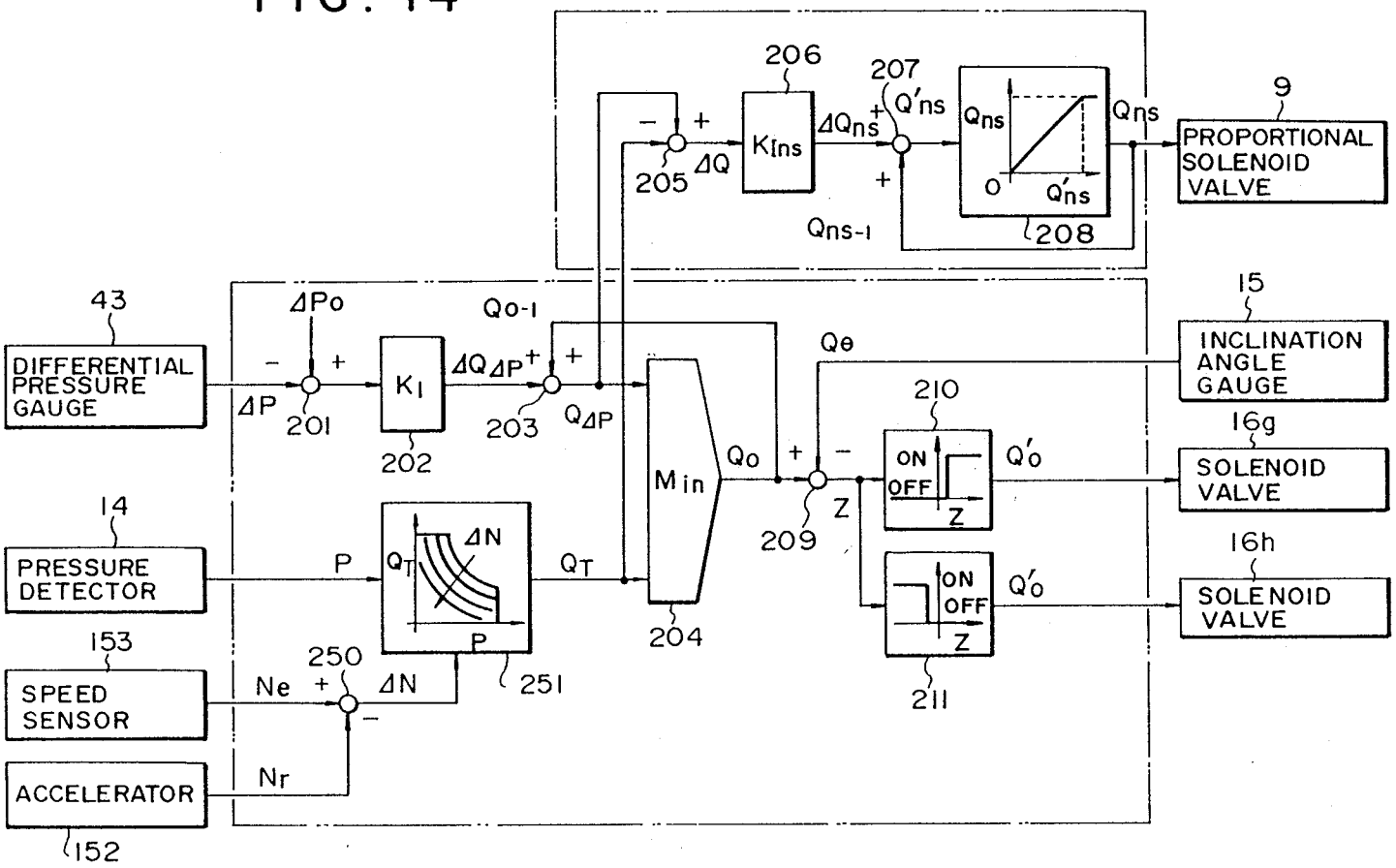
FIG. 14 is a control block diagram of the control system of FIG. 12.

A control block diagram of this embodiment is shown in FIG. 14. In the figure, block 250 compares the actual engine speed signal Ne from the speed sensor 153 with the target engine speed signal Nr from the accelerator 152 to calculate the engine speed deviation ΔN. A block 251 is an input limiting target delivery amount calculation block which inputs the delivery pressure P and the engine speed deviation ΔN for calculating the input limiting target delivery amount QT from the input torque limiting function shown in FIG. 13. Other blocks are the same as those in FIG. 11.

According to this embodiment, the input torque limiting control of pump 1 is performed such that the product of the target delivery amount QT and the delivery pressure P is made smaller with the increasing engine speed deviation ΔN. It is thus possible to effectively utilize the output horsepower of the engine 150 at maximum.

A third embodiment of the present invention will be described with reference to FIGS. 15A and 15B. In the figures, the components similar to those in FIGS. 1 and 11 are denoted at the same reference numerals. In this embodiment, the flow control valve, rather than the pressure balance valve, is controlled directly based on the total consumable flow compensation value Qns.

In the foregoing embodiments, the pressure balance valves 6, 7 of the respective pressure compensated flow control valves are controlled using the compensation value Qns. In this case, the consumable flow rates transmitted to the hydraulic actuators 2, 3 through the respective pressure compensated flow control valves, are determined based on both the throttle opening command values for the flow control valves 4, 5 given by the operation signal from the associated control levers, and the differential pressure command values across the flow control valves given to the pressure balance valves 6, 7 as the compensation values Qns. In this embodiment, the operation signals of the control levers are modified using the compensation value Qns to include the differential pressure command values into the respective throttle opening command values for the flow control valves 6, 7, whereby the consumable flow rates are determined by the resulting throttle opening command values.

Figure 15A:
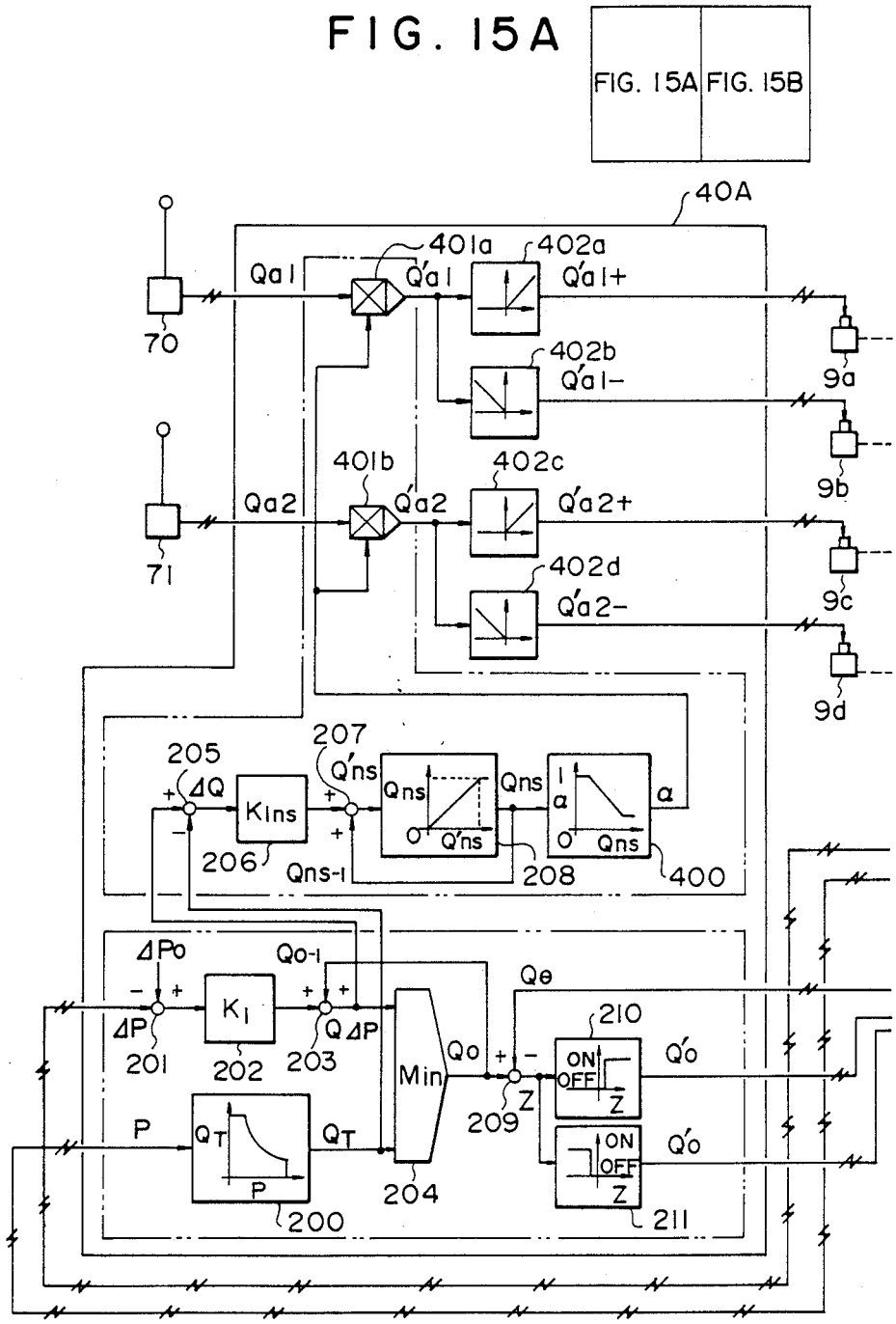
FIGS. 15A and 15B are a control block diagram of a control system for a hydraulic drive circuit according to a third embodiment of the present invention, including the hydraulic drive circuit.
Figure 15B:
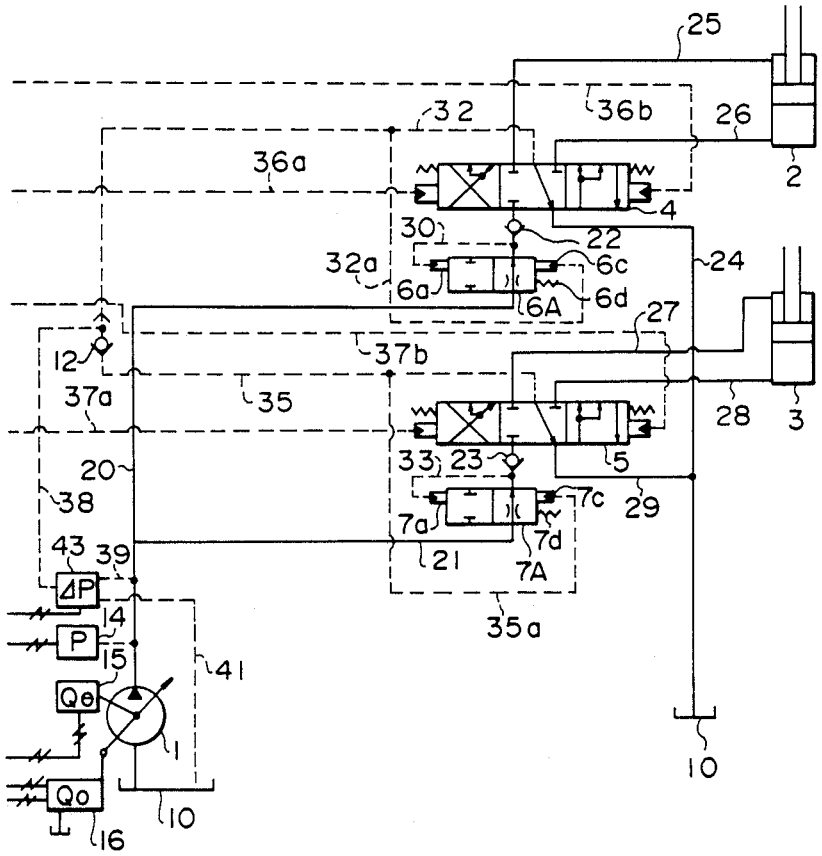

More specifically, in FIGS. 15A and 15B, denoted at 70, 71 are control levers which output operation signals Qa1, Qa2 of the hydraulic actuators 2, 3 when operated, respectively.

A control unit 40A serves, in addition to the function of the control unit 40 in FIG. 1, to input the operation signals Qa1, Qa2 from the control levers 70, 71, convert the input signals to drive signals Q'a1+, Q'a1− and Q'a2+, Q'a2− for proportional solenoid valves 9a–9d, and then output them, respectively.

The proportional solenoid valves 9a–9d produce pilot pressures for operating the flow control valves 4, 5 proportional to the drive signals Q'a1+, Q'a1−, Q'a2+, Q'a2− output from the control unit 40A.

The opening directions and degrees of opening O of flow control valves 4, 5 are controlled opening directions and degrees thereof with the pilot pressures output from the proportional solenoid valves 9a–9d. For example, when the drive signal Q'a1+ is output to the flow control valve 4, the flow control valve 4 is switched to the righthand side as shown with the pilot pressure output from the proportional solenoid valve 9a to take the throttle opening in proportion to Q'a1+. Similarly, when the drive signal Q'a1− is output, the flow control valve 4 is switched to the lefthand side as shown.

The pressure balance valves 6A, 7A are adjusted in their throttle openings to make the differential pressures between inlets and outlets of the flow control valves 4, 5 equal to values set by springs 6d, 7d, respectively. As a result of both flow control valves 4, 5 and pressure balance valves 6A, 7A, the flow rates specified by the drive signals Q'a1− to Q'a2− are supplied to the actuators 2, 3.

In FIG. 15A, the control procedure carried out in control unit 40A is represented in a control block diagram similar to FIG. 11. For this control procedure, the steps for the load-sensing control, up to calculation of Qns in the total consumable flow compensating control, are the same as those for control unit 40 in FIG. 11. Operation of control unit 40A will be described below by referring to the remaining part of the control block diagram.

After calculating the compensation value Qns in the total consumable flow compensating control, control unit 40A determines an operation signal modifying factor $\alpha$ from Qns. The relationship between the factor $\alpha$ and Qns is, for example, such that $\alpha$ is 1 near around 0 of Qns and then decreases as Qns increases, as shown in block 400. Note that the minimum value of $\alpha$ should be larger than 0.

Subsequently, the operation signals Qa1, Qa2 from the control levers 70, 72, which have been input through the A/D converter 40a (see FIG. 5), are multiplied by the operation signal modifying factor $\alpha$ in multipliers 401a, 401b for generating the modified operation signals Qa1', Qa2', respectively.

Then, the modified operation signals Q'a1−, Q'a2− are separated into respective ±pairs by limiters 402a–402d to generate the proportional solenoid drive signals Q'a1+, Q'a1−, Q'a2+, Q'a2 which are output to the proportional solenoid valves 9a–9d.

With the above arrangement, when the differential pressure target delivery amount QΔp is less than the input limiting target delivery amount QT in the load-sensing control, i.e., the pump delivery pressure is not saturated, the compensation value Qns is 0 and hence the operation signal modifying factor becomes 1. Therefore, the modified operation signals Q'a1, Q'a2 are coincident with the operation signals Qa1, Qa2 from the control levers 70, 71, and the flow control valves comes into the same conditions as the case where they are operated by the operation signals Qa1, Qa2.

However, saturation occurs if the total of flow rates demanded by the operation signals Qa1, Qa2 exceeds above the input limiting target delivery amount QT. In this condition, pump 1 is controlled with the input limiting target delivery amount QT. Stated otherwise, when the pump delivery pressure is saturated and the differential pressure target delivery amount QΔp becomes larger than the input limiting target delivery amount QT, the operation signal modifying factor $\alpha$ is made smaller as the compensation value Qns gradually increases from 0. Thus, the operation signals Qa1, Qa2 are multiplied by the operation signal modifying factor $\alpha$ less than 1 in the multipliers 401a, 401b, so that the modified operation signals Q'a1, Q'a2 are gradually reduced. As a result, the flow rates through the flow control valves 4, 5 are also reduced correspondingly.

When the modifying factor $\alpha$ is reduced down to a level at which the total value of the modified operation signals Q'a1, Q'a2 coincides with the input limiting target delivery amount QT, the differential pressure signal ΔP is restored and the differential pressure target delivery amount QΔp is reduced to be coincident with the input limiting target delivery amount QT. Therefore, the target delivery amount deviation ΔQ becomes 0, whereupon an increase of the compensation value Qns and a reduction of the modifying factor $\alpha$ are brought into end.

In this way, delivery amount of the pump 1 and the total demand flow rates through the flow control valves 4, 5 are made coincident with each other, and hences the saturated condition is resolved.

While the operation signals from the control levers have been described as electric signals in the above embodiment, those operation signals may be replaced by hydraulic pilot signals and the hydraulic pressures of the pilot signals may be regulated through a proportional solenoid valve using the operation signal modifying factor $\alpha$.

A fourth embodiment of the present invention will be described with reference to FIG. 16. In this embodiment, during the total consumable flow compensating control, the delivery amount of the pump is controlled to deliver the input limiting target delivery amount QT to prevent interference between the load-sensing control and the total consumable flow compensating control.

More specifically, in the embodiments of FIGS. 1 and 11, when the differential pressure target delivery amount QΔp is larger than the input limiting target delivery amount QT in the saturated condition, the pump is controlled to deliver the input limiting target delivery amount QT. Then, the flow rates through the flow control valves 4, 5 are controlled with the total consumable flow compensation value Qns corresponding to deficiency a in the demanded flow rates commanded by the operated amounts of the flow control valves 4, 5 as compared with the input limiting target delivery amount QT, whereby the saturated condition is solved.

On the other hand, during the condition where the flow rates through the flow control valves 4, 5 are controlled with the compensation value Qns, when the control levers are returned to reduce the operated amounts of the flow control valves 4, 5 and the differential pressure target delivery amount QΔp becomes smaller than the input limiting target delivery amount QT responsive to a reduction in the flow rates through the flow control valves 4, 5, the delivery amount of the pump is limited and reduced to the differential pressure target delivery amount QΔp. At the same time, however, the compensation value Qns is also reduced and hence the flow rates through the flow control valves 4, 5 are increased toward the demand flow rates commanded by the operation signals. During this process, when the flow rates through the flow control valves is about to exceed the delivery capability of the pump, the differential pressure target delivery amount QΔp is increased again above the input limiting target delivery amount QT, which in turn, increases the compensation value Qns, and hence reduces the flow rates through the flow control valves 4, 5. Then, the differential pressure target delivery amount QΔp is increased once again. The above may occur repeatedly. In short, there is a possibility that the load-sensing control and the total consumable flow compensating control proceed simultaneously and interfere with each other, which leads to a hunting phenomenon.

This embodiment has been designed to avoid such a hunting phenomenon. A control block diagram for a control unit 40B of this embodiment is shown in FIG. 16. In the figure, blocks of the same number as those in FIG. 11 carry out the same functions. Note that the component configuration in this embodiment is the same as that in FIG. 1.

Figure 16:
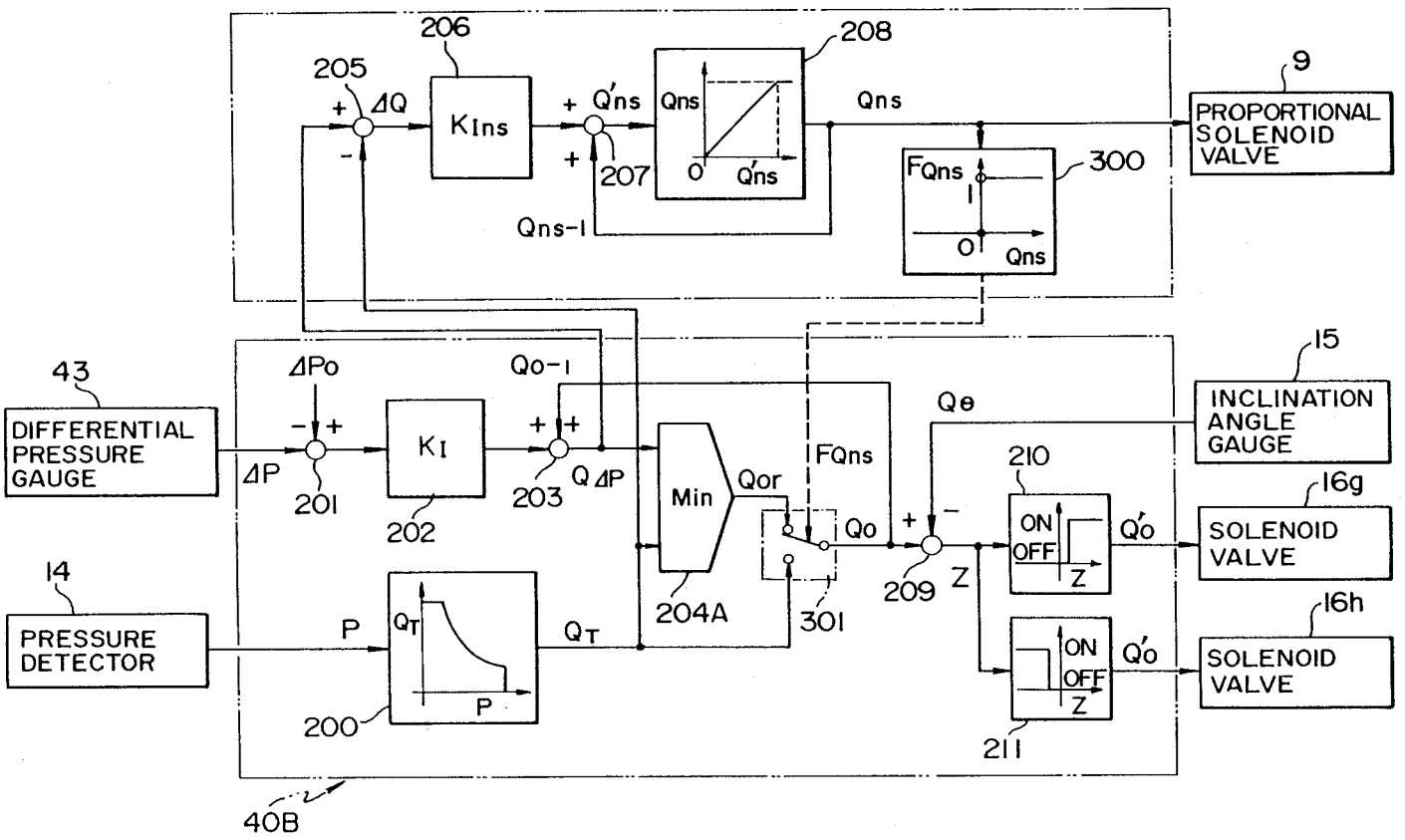
FIG. 16 is a control block diagram of a control system for a hydraulic drive circuit according to a fourth embodiment of the present invention.

In FIG. 16, a block 300 determines whether the total consumable flow compensating control is being performed or not, and then sets a total consumable flow compensating flag FQns. This decision is made based on the total consumable flow compensation value Qns, such that the total consumable flow compensating control is not being performed when Qns is equal to or less than 0, and is being performed when Qns is above 0. The flag FQns is set to 1 or 0 dependent on whether or not the total consumable flow compensating control is being performed.

A block 204A is a minimum value selection block which determines which of the input limiting target delivery amount QT and the differential pressure target delivery amount QΔp is smaller, and then and outputs the smaller one as a delivery amount target value Qor.

Block 301 is a delivery amount target value selector switch for the pump. Upon receiving the total consumable flow compensating flag FQns, when FQns is 0 the switch selects the delivery amount target value Qor selected by the minimum value selection block 204A, and when FQns is 1 input limiting target delivery amount is selected to be QT. Then the selected value is outputted as a delivery amount target value Qo.

The remaining blocks in FIG. 16 are the same as those in FIG. 11.

Operation of this embodiment will now be described. In the condition where the total of demand flow rates commanded by the operation signals for the flow control valves 4, 5 is smaller than the input limiting target delivery amount QT, the differential pressure target delivery amount QΔp is less than QT and block 204A selects the differential pressure target delivery amount QΔp as the selected delivery amount target value Qor. Simultaneously, the total consumable flow compensation value Qns becomes 0. At this time, the flag FQns is set to 0 and the delivery amount target value selector switch 301 selects the selected delivery amount target value Qor as the delivery amount target value Qo. As a result, the pump 1 is controlled to the differential pressure target delivery amount QΔp.

When the operation signals for the flow control valves 4, 5 are increased and the total of demand flow rates becomes larger than the input limiting target delivery amount QT, the differential pressure target delivery amount QΔp exceeds QT and hence the block 204A selects QT as the delivery amount target value Qor. Simultaneously, the target delivery amount deviation ΔQ becomes positive (+) and the compensation value Qns is increased. At this time, the flag FQns is set to 1 and the delivery amount target value selector switch 301 selects the input limiting target delivery amount QT as the delivery amount target value Qo. As a result, the pump 1 is controlled to the input limiting target delivery amount QT. Further, the flow rates through the flow control valves 4, 5 are reduced using the compensation value Qns which is coincident with the input limiting target delivery amount QT, with the result that the saturated condition is solved.

Up to this point, the embodiment of FIG. 16 operates in a like manner to that of FIG. 11.

Thereafter, when the operation signals for the flow control valves 4, 5 are reduced and the flow rates therethrough are also reduced. The differential pressure target delivery amount QΔp is reduced and becomes smaller than the input limiting target delivery amount QT. Then, block 204A selects QΔp as the delivery amount target value Qor. At this time, although the target delivery amount deviation ΔQ becomes negative (−), the total consumable flow compensation value Qns remains positive (+) and the flag FQns is held at 1 because Qns is gradually reduced in a transient range. Therefore, the delivery amount target value selector switch 301 selects the input limiting target delivery amount QT as the delivery amount target value Qo and the pump 1 is hence held controlled to QT. This condition continues until the compensation value Qns is reduced and the total of flow rates through the flow control valves 4, 5 becomes coincident with QT. This keeps the pump 1 from being controlled to the differential pressure target delivery amount QΔp and prevents interference with the total consumable flow compensating control.

When the total of demand flow rates commanded by the operation signals for the flow control valves 4, 5 is reduced below the input limiting target delivery amount QT, the differential pressure target delivery amount QΔp becomes smaller than QT. But, the delivery amount target value Qo is held at QT because the flag FQns remains at 1 while the compensation value Qns assumes a positive (+) value. Therefore, Qns is gradually reduced while the delivery amount of the pump 1 is still held at QT, and this reduction continues until Qns becomes 0. When the flag FQns is switched to 0 upon the compensation value Qns reaching 0, the delivery amount target value selector switch 301 selects the differential pressure target delivery amount QΔp as the delivery amount target value Qo. Thereafter, QΔp is controlled to be coincident with the total of demand flow rates commanded by the operation signals for the flow control valves 4, 5.

According to this embodiment, in addition to the advantage of the embodiment shown in FIGS. 1 and 11, it is possible to prevent interference between the total consumable flow compensating control and the load-sensing control of the hydraulic pump and hence carry out stable control, even when the total of demand flow rates commanded by the operation signals from the control levers is reduced from the condition of total consumable flow compensating control.

A fifth embodiment of the present invention will be described with reference to FIG. 17. This embodiment is different from that of FIG. 16 in that the input limiting target delivery amount is calculated integrally rather than proportionally. The component arrangement is, therefore, similar to that shown in FIG. 1 as with the embodiment of FIG. 16.

Figure 17:
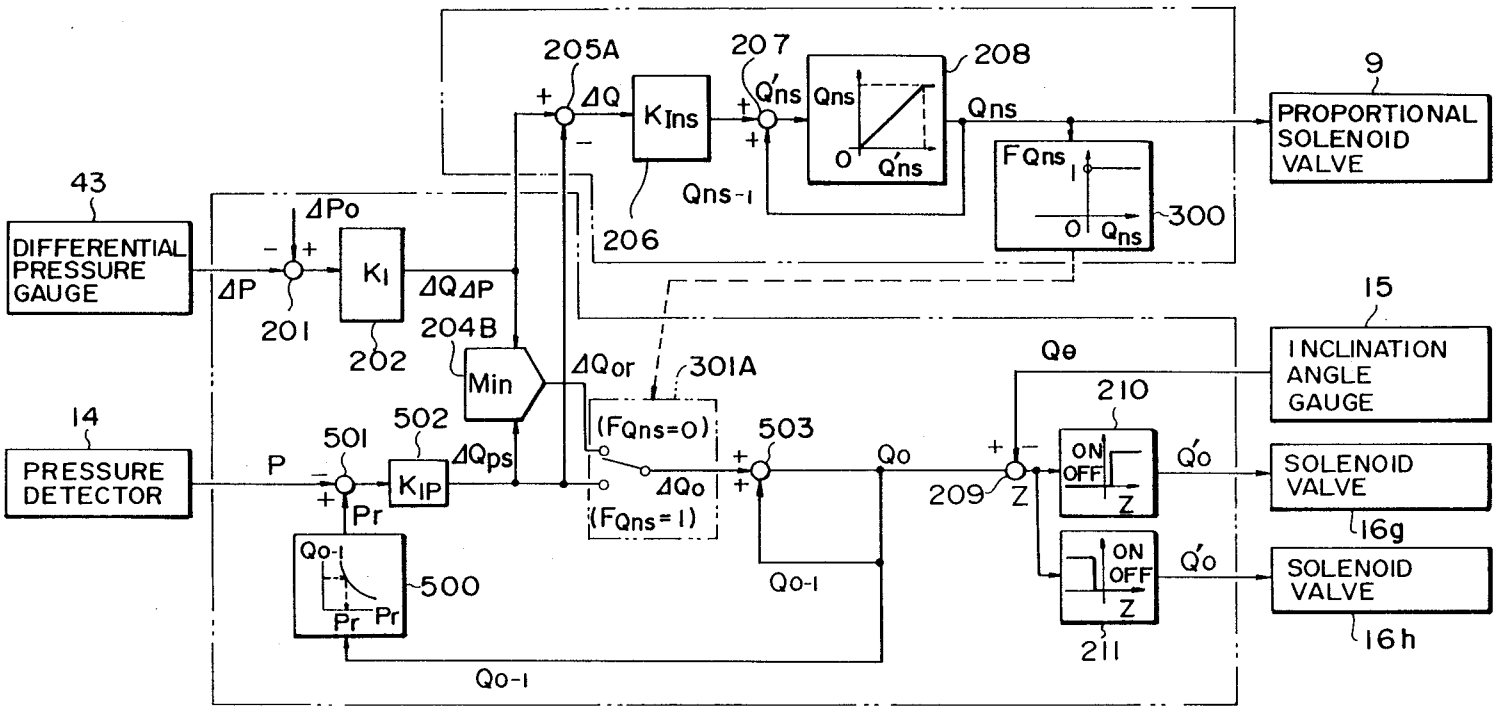
FIG. 17 is a control block diagram of a control system for a hydraulic drive circuit according to a fifth embodiment of the present invention.

In FIG. 17, block 500 is a target delivery pressure calculation block which inputs the preceding delivery amount target value Qo−1 and calculates a currently allowable target delivery pressure Pr from the preset input limiting torque for the pump 1. The target delivery pressure Pr is sent to a differential pressure calculation block 501 where the target delivery pressure Pr is compared with the current delivery pressure P to calculate a calculated differential pressure ΔP. The differential pressure ΔP is multiplied by the integration gain $K_{IP}$ in an input limiting target delivery amount increment calculation block 502 to calculate an increment ΔQps of the input limiting target delivery amount per one unit of control cycle time.

The increment ΔQps of the input limiting target delivery amount and an increment ΔQΔp of the differential pressure target delivery amount are sent to a delivery amount increment minimum value selector block 204B that determines which of the two increments is smaller and then outputs the smaller one as a target delivery amount increment ΔQor.

Upon receiving the total consumable flow compensating flag FQns output from the block 300, the delivery amount increment selector switch 301A selects the target delivery amount increment ΔQor selected by the delivery amount increment minimum value selector block 204B when FQns is 0 and the input limiting target delivery amount increment ΔQps when FQns is 1, and then outputs the selected one as a delivery amount increment ΔQo.

The delivery amount increment ΔQo selected by the delivery amount increment selector switch 301A is added in a block 503 to the delivery amount target value Qo−1 calculated in the preceding control cycle for calculating the delivery amount target value Qo in this cycle. The input limiting target delivery amount increment ΔQps and the differential pressure target delivery amount ΔQΔp are sent to a block 205A for calculating a signal indicative of the difference therebetween as the target delivery amount deviation ΔQ.

The remaining blocks in FIG. 17 are similar to those in FIG. 16.

In FIG. 17, the flow through the blocks 201, 202, 204B, 301A, 503 are the same as that through the blocks 201, 202, 203, 204A, 301 in the load-sensing control of FIG. 16 for calculating the differential pressure target delivery amount. On the other hand, the flow through the blocks 500, 501, 502, 204B, 301A, 503 is substituted for that through the blocks 200, 204A, 301 in FIG. 16 for calculating the input limiting target delivery amount.

While proportional type control is performed in FIG. 16 by directly calculating the input limiting target delivery amount QT from the delivery pressure P of the pump 1, the input limiting target value is calculated in the embodiment of FIG. 17 under integral type control such that the delivery amount increment ΔQps necessary for control following the target delivery pressure Pr computed from the input limiting torque of the pump is calculated and then added to the preceding delivery amount target value. It is to be noted that minimum value selector block 204B and the selector switch 301A are designed to act on the delivery amount increment in the block diagram of FIG. 17 because of the following reason.

If the target delivery amount is calculated in this embodiment like that of FIG. 16:

$$QT = Qo - 1 + \Delta Qps \quad (5)$$

$$Q\Delta p = Qo - 1 + \Delta Qp \quad (6)$$

Here, since $$Qo = \text{Select (Min } (QT, Q\Delta p), QT),$$

substitution of the equations (5), (6) leads to:

$$Qo = Qo - 1 + \text{Select (Min } (\Delta Qps, \Delta Q\Delta p), \Delta Qps)$$

Thus, both the embodiments of FIGS. 16 and 17 carry out the same function. Stated otherwise, in the load-sensing control of FIG. 17, the increment of the differential pressure target delivery amount calculated from control of the differential pressure is always compared with the increment of the input limiting target delivery amount calculated from the limiting torque, and the minimum value therebetween is added to the current pump delivery amount for determining how the pump delivery amount should be controlled based on which one of the differential pressure and the limiting torque is used.

Furthermore, if the target delivery amount is also used in block 205A in FIG. 17 for calculating the target delivery amount deviation as with the block 205 in FIG. 16:

$$\Delta Q = Q\Delta p - QT$$

Here, substitution of the equations (5), (6) leads to:

$$\Delta Q = (Qo - 1 + \Delta Q\Delta p) - (Qo - 1 + \Delta Q\Delta p) = \Delta Q\Delta p - \Delta Qps$$

Thus, the block 205A in FIG. 17 becomes equivalent to the block 205 in FIG. 16. The remaining blocks subsequent to block 206 operates in the exactly same manner as those in FIG. 16.

This embodiment functions in a like manner to that of FIG. 16. Specifically, the total consumable flow compensation value Qns is determined based on the deviation ΔQ between the available delivery amount of the pump and the target delivery amount determined from the differential pressure, and the resulting Qns is employed to control the pressure balance valve for solving the saturated condition. Also, while the pressure balance value is under total consumable flow compensating control, the pump is controlled to the input limiting target delivery amount to avoid interference with the total consumable flow compensating control.

In this embodiment, however, because of the integral calculation of the input limiting target delivery amount, the new target delivery amount Qo is always calculated from the preceding target delivery amount Qo−1 and the transition is hence smoothed when the pump is shifted from the condition where it is controlled following the differential pressure target delivery amount to the condition where it is controlled following the input limiting target delivery amount, or vice versa. Accordingly, the pump will not be subject to any rush operation and can control more stably at the time of shifting the control mode.

Figure 18:
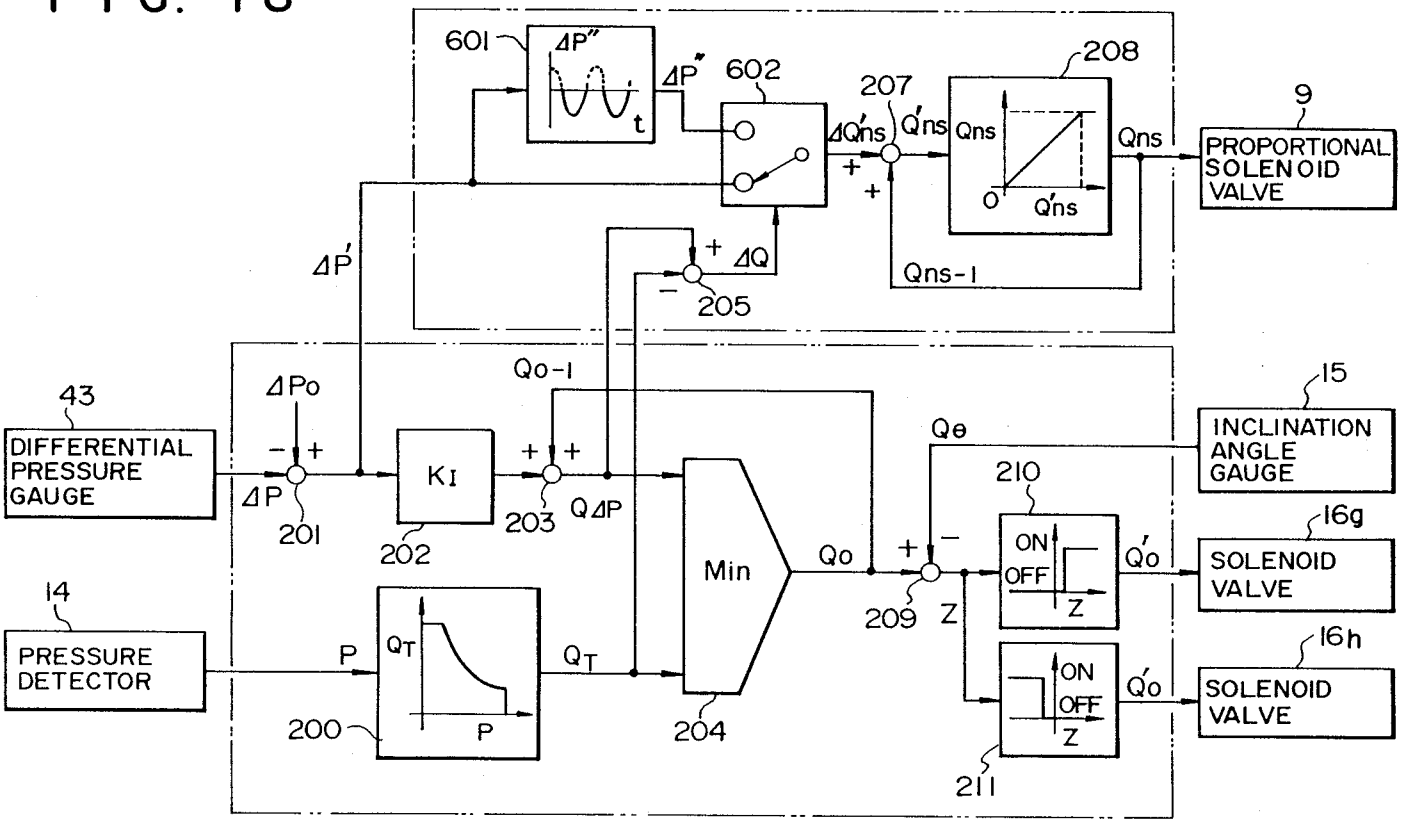
FIG. 18 is a control block diagram of a control system for a hydraulic drive circuit according to a sixth embodiment of the present invention.

A sixth embodiment of the present invention will now be described with reference to FIG. 18. In the figure, the same components as those shown in FIG. 11 are denoted with the same reference numerals. This embodiment is different from the foregoing ones in the arrangement of the block which calculates the total consumable flow compensation value Qns.

More specifically, block 601 is a half-wave rectifier which inputs a differential pressure deviation $\Delta P' = \Delta Po - \Delta P$ calculated by the adder 201, and then outputs $\Delta P''=0$ when $\Delta P' \geqq 0$ and $\Delta P''=\Delta P'$ when $\Delta P'<0$. The output $\Delta P''$ of the half-wave rectifier 601 and the differential pressure deviation $\Delta P'$ are both input to a signal selector switch 602. Upon receiving the output $\Delta Q$ from the adder 205, the signal selector switch 602 selects the value $\Delta P'$ when $\Delta Q$ is positive, i.e., in case of the differential pressure target delivery amount $Q\Delta P \geqq$ the input limiting target delivery amount QT, and the value $\Delta P''$ when $\Delta Q$ is negative, i.e., in case of $Q\Delta p<QT$, followed by outputting the selected one as an increment $\Delta Q'ns$ of an intermediate value. This increment $\Delta Q'ns$ is added to the output Qns−1 of the preceding control cycle in the adder 207 to obtain the intermediate value Q'ns. The value Q'ns is then sent to the limiter 208. The limiter 208 prevents the value Q'ns from exceeding a maximum limit and outputs it as the total consumable flow compensation value Qns.

With the above arrangement, when the differential pressure target delivery amount $Q\Delta P$ is larger than the input limiting target delivery amount QT and total consumable flow compensating control is necessary, the signal selector switch 602 selects $\Delta P'$ (>0) as the intermediate value Q'ns and the pressure compensated flow control valve is controlled for compensation using the compensation value Qns produced from the positive $\Delta P'$. To the contrary, when there is no need for the total consumable flow compensating control, i.e., $Q\Delta p<QT$, even though the differential pressure $\Delta P$ is reduced due to response delay in the load-sensing control of the pump, $\Delta P''$, obtained by removing the positive portion by the half-wave rectifier 601, is selected as the increment $\Delta Q'ns$ of the intermediate value, so that the pressure compensated flow control valve will not be controlled for compensation because Q'ns=Qns=0. On the other hand, when the control lever is returned and the pump is controlled following the differential pressure target delivery amount $Q\Delta p$ while the pressure compensated flow control valve is under the total consumable flow compensating control, the differential pressure $\Delta P$ is increased and hence the differential pressure deviation $\Delta P'$ becomes negative. Thus, the value of $\Delta P'$ is not removed by the half-wave rectifier 601 and the pressure compensated flow control valve is controlled with the reduced compensation value Qns, obtained from the negative $\Delta P'$, toward release of the total consumable flow compensating control.

In this manner, this embodiment can function similar to the first embodiment.

Note that although the adder 207 and the limiter 208 are used to perform calculations of the integral control type in this embodiment, proportional control type calculation may instead be implemented.

Figure 19:
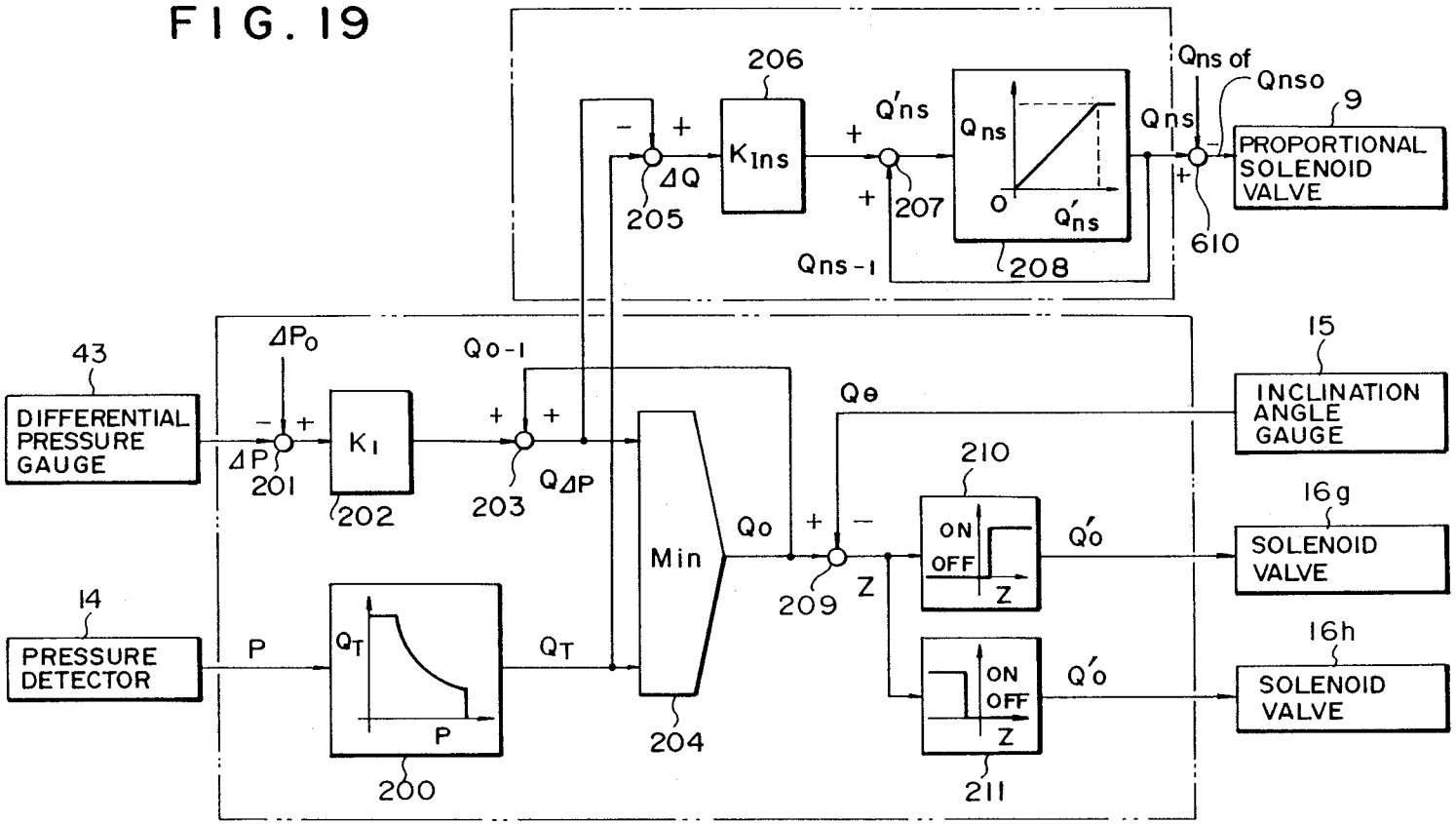
FIG. 19 is a control block diagram of a control system for a hydraulic drive circuit according to a seventh embodiment of the present invention.

A seventh embodiment of the present invention will be described with reference to FIG. 19. Likewise, the same components in FIG. 19 as those shown in FIG. 11 are denoted at the same reference numerals. This embodiment is different from the foregoing ones in that the total consumable flow compensation value Qns is further modified.

In a track apparatus of a hydraulic excavator, for example, the hydraulic fluid is supplied to righthand and lefthand track motors through the associated pressure compensated flow control valves. But, the performance of this track apparatus would suffer if the foregoing total consumable flow compensating control is strictly performed. More specifically, when the hydraulic excavator is travelling straight, a slight difference in the supply amount of hydraulic fluid between the lefthand and righthand track motors occurs due to small variations in the individual components such as the pressure balance valves and the flow control valves. This makes rotational speeds of the track motors slightly different from each other, whereby the vehicle body will slowly turn to the right or left.

In order to the above drawback, an adder 610 is provided in this embodiment to subtract a small offset value Qnsof from the compensation value Qns and the resulting difference is output as a final compensation value Qnso.

By so doing, the total consumable flow rate given by Qnso becomes slightly greater than the available maximum delivery flow rate of the pump by an extent corresponding to the offset value Qnsof. The system then produces a corresponding free flow rate in the delivery amount of the pump, which can pass into the track motor on the lower pressure side. Such a free flow rate can be utilized advantageously depending on the situation. For example, if the vehicle body equipped with the above track apparatus tends to turn to the left slowly because of the fact that the righthand track motor is supplied with the larger supply flow rate than the lefthand track motor due to variations in the individual components, the righthand track motor would produce larger drive torque than the lefthand track motor. Hence, the hydraulic pressure is increased on the righthand side which allows, the free flow rate caused by the offset value Qnsof to pass into the lefthand track motor under the lower load pressure. As a result, the vehicle body is automatically released from its tendency to curve to the left and can travel straight.

It is to be understood that in the previous example, most parts of the flow rate are under the total consumable flow compensating control which ensures a certain supply of hydraulic fluid to the higher pressure side as well. Accordingly, when the operator turns a steering mechanism hydraulic fluid can be supplied to the track motor on the side toward which the steering is turned, allowing the vehicle to turn correspondingly.

Thus, this embodiment makes it possible to solve the drawback as would be experienced in case of strictly performing the total consumable flow compensating control.

As will be apparent from the foregoing, according to the present invention, the differential pressure target delivery amount $Q\Delta p$ and the input limiting target delivery amount QT are independently calculated as the target delivery amount Qo of the pump, and the total consumable flow compensating control is carried out only when the input limiting target delivery amount QT is selected. Therefore, where the delivery amount of the pump is less than its available maximum delivery amount (the input limiting target delivery amount QT), the load-sensing control is carried out, while in the condition where it reaches the available maximum delivery amount (the input limiting target delivery amount QT), the total consumable flow compensating control is carried out. This enables a smooth increase or decrease the flow rates supplied to the respective hydraulic actuators and hence improves the operability. It is also possible to prevent a hunting phenomenon due to interference between the load-sensing control and the total consumable flow compensating control, resulting in stable control.

Further, in case of integrally calculating the input limiting target delivery amount, the new target delivery amount Qo is always calculated from the preceding target delivery amount Qo−1 and the transition is hence smoothed when the pump is shifted from the condition where it is controlled following the differential pressure target delivery amount QΔp to the condition where it is controlled following the input limiting target delivery amount QT, or vice versa, thereby ensuring more stable control.

In addition, when the total consumable flow compensating control is not desired to be strictly effected, the amount of consumable flow compensating control can be reduced.

What is claimed is:

1. A control system for a load-sensing hydraulic drive circuit comprising: at least one hydraulic pump; a plurality of hydraulic actuators driven with hydraulic fluid delivered from said hydraulic pump; and a pressure compensated flow control valve connected between said pump and each of said actuators, for controlling a flow rate of the fluid supplied to each said actuator in response to an operation signal from control means, wherein said control system comprises:

first detection means for detecting a differential pressure between the delivery pressure of said pump and the maximum load pressure among said plurality of hydraulic actuators;

second detection means for detecting the delivery pressure of said pump;

first means for calculating, based on a differential pressure signal from said first detection means, a differential pressure target delivery amount QΔp of said pump to hold said differential pressure constant;

second means for calculating an input limiting target delivery amount QT of said pump based on at least a pressure signal from said second detection means and an input limiting function preset for said pump;

third means for selecting one of said differential pressure target delivery amount QΔp and said input limiting target delivery amount QT as a delivery amount target value Qo for said pump, and then controlling the delivery amount of said pump such that the delivery amount does not exceed above said input limiting target delivery amount QT; and fourth means for calculating a compensation value Qns to limit a total consumable flow rate for said actuator based on at least said input limiting target delivery amount QT and said differential pressure target delivery amount QΔp when said input limiting target delivery amount QT is selected by said third means, and then controlling said pressure compensated flow control valve based on said compensation value Qns.

2. A control system for a load-sensing hydraulic drive circuit according to claim 1, wherein said fourth means controls a pressure balance valve of said pressure compensated flow control valve based on said compensation value Qns.

3. A control system for a load-sensing hydraulic drive circuit according to claim 1, wherein said fourth means calculates an operation signal modifying factor $\alpha$ from said compensation value Qns, modifies said operation signal from said control means using said operation signal modifying factor $\alpha$, and controls said pressure compensated flow control valve using the corrected operation signal.

4. A control system for a load-sensing hydraulic drive circuit according to claim 1, wherein said third means selects smaller one of said differential pressure target delivery amount QΔp and said input limiting target delivery amount QT as the delivery amount target value Qo for said pump.

5. A control system for a load-sensing hydraulic drive circuit according to claim 1, wherein said third means selects said differential pressure target delivery amount QΔp as the delivery amount target value Qo for said pump when said compensation value Qns is zero, and said input limiting target delivery amount QT as the delivery amount target value Qo for said pump when said compensation value Qns is not zero.

6. A control system for a load-sensing hydraulic drive circuit according to claim 1, wherein said fourth means includes adder means to determine a target delivery amount deviation ΔQ as a deviation between said differential pressure target delivery amount QΔp and said input limiting target delivery amount QT, and calculates said compensation value Qns using at least said target delivery amount deviation ΔQ.

7. A control system for a load-sensing hydraulic drive circuit according to claim 6, wherein said fourth means further includes integral type calculation means to calculate an increment ΔQns of said compensation value Qns from said target delivery amount deviation ΔQ for making said deviation zero, and then add said increment ΔQns to a previously calculated compensation value Qns−1 to determine the compensation value Qns, and limiter means for generating Qns=0 when said compensation value Qns is a negative value.

8. A control system for a load-sensing hydraulic drive circuit according to claim 6, wherein:

said first means includes adder means to calculate a differential pressure deviation ΔP′ between the differential pressure signal from said first detection means and the preset target differential pressure; and said fourth means further includes filter means for outputting zero when said differential pressure deviation ΔP′ is positive and a value ΔP″ equal to said differential pressure deviation ΔP′ when it is negative, selector means for selecting an output ΔP″ of said filter means when said target delivery amount deviation ΔQ is negative and the output ΔP′ of said adder means when said target delivery amount deviation ΔQ is positive, and calculation means for calculating said compensation value Qns from the value ΔP″ or ΔP′ selected by said selector means.

9. A control system for a load-sensing hydraulic drive circuit according to claim 1, wherein said fourth means calculates a deviation between said compensation value Qns and a preset offset value, and then outputs a resulting value Qnso as the final compensation value.

10. A control system for a load-sensing hydraulic drive circuit according to claim 1, wherein:

said first means comprises an integral type calculation means which calculates, based on the differential pressure signal from said first detection means, an increment $\Delta Q\Delta p$ of said differential pressure target delivery amount $Q\Delta p$ for holding said differential pressure constant, and then adds said increment $\Delta Q\Delta p$ to the previously calculated differential target delivery amount $Qo-1$ for determining the differential pressure target delivery amount $Q\Delta p$;

said second means comprises an integral type calculation means which calculates an increment $\Delta Qps$ of said input limiting target delivery amount QT for controlling the pressure signal from said second detection means to a target delivery pressure Pr obtained from the input limiting function of said pump, and then adds said increment $\Delta Qps$ to the previously calculated input limiting target delivery amount $Qo-1$ for determining the input limiting target delivery amount QT; and said third means comprises means for selecting one of the increment $\Delta Q\Delta p$ of said differential pressure target delivery amount $Q\Delta p$ and the increment $\Delta Qps$ of said input limiting target delivery amount QT for selecting one of said differential pressure target delivery amount $Q\Delta p$ and said input limiting target delivery amount QT.

11. A control system for a load-sensing hydraulic drive circuit according to claim 1, wherein the input limiting function of said second means is an input torque limiting function with one of the delivery pressure and the input limiting target delivery amount of said pump as a parameter, and said second means calculates the input limiting target delivery amount QT of said pump based on both the pressure signal of said second detection means and said input torque limiting function.

12. A control system for a load-sensing hydraulic drive circuit according to claim 1, wherein:

said control system further includes third detection means for determining a deviation between the target speed and the actual speed of a prime mover for driving said pump; and the input limiting function of said second means is an input torque limiting function with one of the delivery pressure and the input limiting target delivery amount of said pump and the speed deviation of said prime mover as parameters, and said second means calculates the input limiting target delivery amount QT of said pump based on the pressure signal of said second detection means, the speed deviation signal of said third detection means and said input torque limiting function.

* * * * *